US009778593B2

(12) United States Patent
Hirai et al.

(10) Patent No.: US 9,778,593 B2
(45) Date of Patent: Oct. 3, 2017

(54) IMAGE FORMING APPARATUS

(71) Applicants: Shuji Hirai, Tokyo (JP); Satoshi Kaneko, Kanagawa (JP); Terumichi Ochi, Kanagawa (JP)

(72) Inventors: Shuji Hirai, Tokyo (JP); Satoshi Kaneko, Kanagawa (JP); Terumichi Ochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/971,106

(22) Filed: Dec. 16, 2015

(65) Prior Publication Data

US 2016/0187807 A1 Jun. 30, 2016

(30) Foreign Application Priority Data

Dec. 24, 2014 (JP) ..... 2014-260951
Nov. 2, 2015 (JP) ..... 2015-215438

(51) Int. Cl.
*G03G 15/06* (2006.01)
*G03G 15/02* (2006.01)
*G03G 15/043* (2006.01)

(52) U.S. Cl.
CPC ..... *G03G 15/065* (2013.01); *G03G 15/0266* (2013.01); *G03G 15/043* (2013.01)

(58) Field of Classification Search
CPC ..... G03G 15/065; G03G 15/043; G03G 15/0266

(Continued)

(56) References Cited

U.S. PATENT DOCUMENTS 5,351,107 A * 9/1994 Nakane ..... G03G 15/5041 347/131
2011/0063683 A1 3/2011 Kaneko et al.
(Continued)

FOREIGN PATENT DOCUMENTS

JP 62-145266 6/1987
JP 9-062042 3/1997
(Continued)

OTHER PUBLICATIONS

U.S. Appl. No. 14/802,322, filed Jul. 17, 2015, Satoshi Kaneko, et al.

(Continued)

*Primary Examiner* — Hoang Ngo
(74) *Attorney, Agent, or Firm* — Oblon, McClelland, Maier & Neustadt, L.L.P.

(57) ABSTRACT

An image forming apparatus includes an image forming section that includes a latent image bearer; a charger to charge a surface of the latent image bearer; and a latent image writer to write a latent image on the charged surface of the latent image bearer. The image forming apparatus further includes a developing device to develop the latent image with a developer borne on a developer bearer; and a cyclical changing device including a controller and a write controller, in combination. The cyclical changing device cyclically changes a developing bias to be applied to the developer bearer while cyclically changing a charge intensity of the charger during the image formation by the image forming section. The cyclical changing device cyclically changes the developing bias and the charge intensity, and a latent image write intensity of the latent image writer.

20 Claims, 23 Drawing Sheets

(58) Field of Classification Search
USPC ..... 399/49, 50, 55, 56, 46, 51
See application file for complete search history.

(56) References Cited

U.S. PATENT DOCUMENTS

| | | | | |
|---|---|---|---|---|
| 2011/0200347 | A1* | 8/2011 | Hirobe | G03G 15/5041 399/49 |
| 2012/0099165 | A1 | 4/2012 | Omori et al. | |
| 2012/0201552 | A1 | 8/2012 | Hirai et al. | |
| 2013/0004207 | A1 | 1/2013 | Hirayama et al. | |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |
| 2014/0169814 | A1 | 6/2014 | Uematsu et al. | |
| 2014/0268242 | A1 | 9/2014 | Kaneko et al. | |
| 2014/0270827 | A1 | 9/2014 | Muto et al. | |
| 2014/0270828 | A1 | 9/2014 | Suzuki et al. | |
| 2014/0301748 | A1 | 10/2014 | Suzuki et al. | |
| 2015/0261162 | A1 | 9/2015 | Kaneko et al. | |

FOREIGN PATENT DOCUMENTS

| | | |
|---|---|---|
| JP | 2000-098675 | 4/2000 |
| JP | 2006-106556 | 4/2006 |
| JP | 2007-140402 | 6/2007 |
| JP | 2012-108454 | 6/2012 |
| JP | 2012-163645 | 8/2012 |
| JP | 2012-237875 | 12/2012 |
| JP | 2013-190681 | 9/2013 |

OTHER PUBLICATIONS

U.S. Appl. No. 14/924,826, filed Oct. 28, 2015, Satoshi Kaneko, et al.
U.S. Appl. No. 14/726,847, filed Jun. 1, 2015.

* cited by examiner

| FIG. 7A |
| --- |
| FIG. 7B |

IMAGE FORMING APPARATUS

CROSS-REFERENCE TO RELATED APPLICATIONS

The present application claims priority pursuant to 35 U.S.C. §119(a) from Japanese patent application numbers 2014-260951 and 2015-215438, filed on Dec. 24, 2014, and Nov. 2, 2015, the entire disclosure of each of which is incorporated by reference herein.

BACKGROUND

1. Technical Field

The present invention relates to an image forming apparatus.

2. Background Art

When an image is formed by an image forming unit disposed in an image forming apparatus, a charger charges a surface of a latent image bearer while cyclically changing a power of the charger, to thereby cyclically change a developing bias to be applied to a developer bearer of a developing device.

For example, the above image forming apparatus forms a latent image on the latent image bearer and develops the latent image while cyclically changing the charging power and the developing bias, to thus form a toner image. Specifically, the image forming apparatus allows an electrostatic latent image formed on the latent image bearer or a photoconductor to be developed by a developer borne on a developing roller, to thereby obtain a toner image. At that time, cyclical variation in the image density caused by variations in the development gap between the photoconductor and the developing roller in accordance with the rotation of the photoconductor due to a distortion in the external surface of the photoconductor is suppressed.

Specifically, the developing bias is cyclically changed based on readings by a rotary encoder as to the rotary attitude of the photoconductor and a predetermined variation pattern of the development. With this structure, the image density variation in a solid portion of the image due to the gap variation can be canceled by the image density variation in the solid portion due to the change in the developing bias, so that the image density variation in the solid portion followed by the rotation of the photoconductor can be suppressed.

That is, based on the detected rotary attitude of the photoconductor and a predetermined charge variation pattern, the charge intensity or strength is cyclically changed by the cyclical change in the charging bias to be applied to the charging member that uniformly charges the surface of the photoconductor. With this structure, occurrence of the cyclic image density variation in a halftone image due to cyclically changing the developing bias can be suppressed.

SUMMARY

In one exemplary embodiment of disclosure, provided is an optimal image forming apparatus including an image forming section that includes a latent image bearer; a charger to charge a surface of the latent image bearer; and a latent image writer to write a latent image on the charged surface of the latent image bearer. The image forming apparatus further includes a developing device to develop the latent image with a developer borne on a developer bearer; and a cyclical changing device including a controller and a write controller, in combination. The cyclical changing device cyclically changes a developing bias to be applied to the developer bearer while cyclically changing a charge intensity of the charger during the image formation by the image forming section. The cyclical changing device cyclically change the developing bias and the charge intensity, and a latent image write intensity of the latent image writer.

These and other objects, features, and advantages of the present invention will become apparent upon consideration of the following description of the preferred embodiments of the present invention when taken in conjunction with the accompanying drawings.

DETAILED DESCRIPTION

The cyclical image density variation in the halftone image occurs due to cyclically changing the developing bias occurs because, unlike a solid image, dot forming portions and empty portions coexist in the halftone image. In addition, the dot portion includes one type in which a plurality of dots exists with each peripheral portion overlapping each other and another type in which isolated dots exist with no overlapping portions. The isolated dot tends to receive an edge effect and tends to bear more amount of toner compared to the not-isolated dot. The edge effect relative to the isolated dot receives an effect of the potential difference between an electrical potential of the non-dot portion, that is, a background potential, adjacent to the isolated dot, and the developing bias, and appears more noticeable as the potential difference becomes greater. When the developing bias is cyclically changed to suppress the cyclical variation in the image density of the solid image, because the potential difference cyclically changes accordingly, the cyclical variation in the image density occurs in the halftone image. In the above image forming apparatus, by cyclically changing the charging bias, the cyclical variation in the potential difference due to the cyclically changing the developing bias, can be suppressed, and the cyclical variation in the image density of the halftone image can be suppressed.

However, even by cyclically changing the developing bias and the charging bias, the cyclical image density variation still remain.

Preferred embodiments of a full-color image forming apparatus (hereinafter, simply a copier) employing an electrophotographic method, as an apparatus to which the present invention is applied, will now be described.

Figure 1:
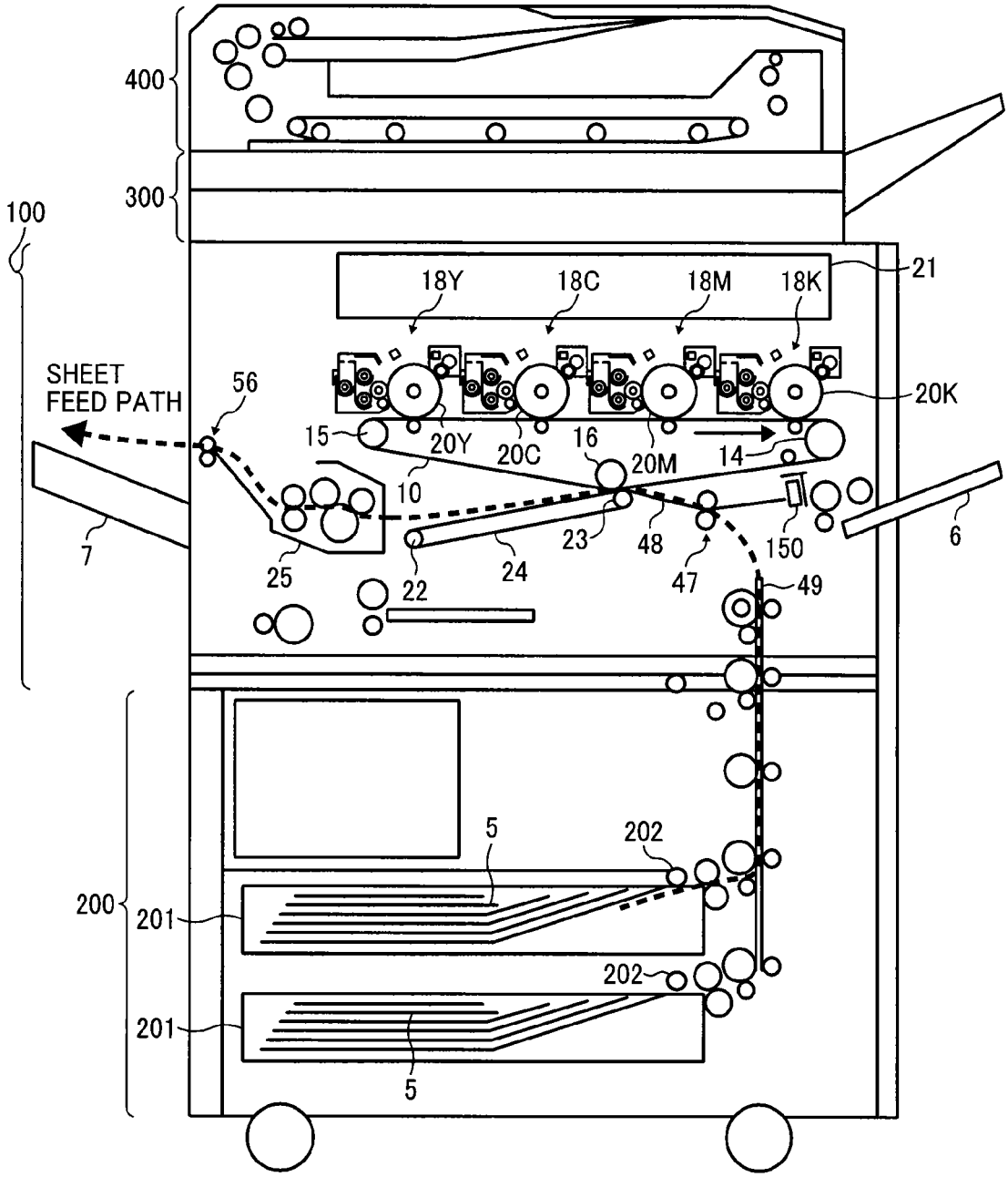
FIG. 1 schematically illustrates an image forming apparatus or a copier according to an embodiment of the present invention.

A basic structure of the copier will be first described. FIG. 1 schematically illustrates the copier according to an embodiment of the present invention. As illustrated in FIG. 1, the copier includes an image forming section 100 to form an image on a recording sheet, a sheet feed device 200 to supply a recording sheet 5 to the image forming section 100, and a scanner 300 to read the image in an original. In addition, an automatic document feeder (ADF) 400 is disposed on an upper part of the scanner 300. The image forming section 100 includes a manual tray 6 to set the recording sheet 5 manually, and a stack tray 7 to stack the recording sheet 5 on which the image has been formed.

Figure 2:
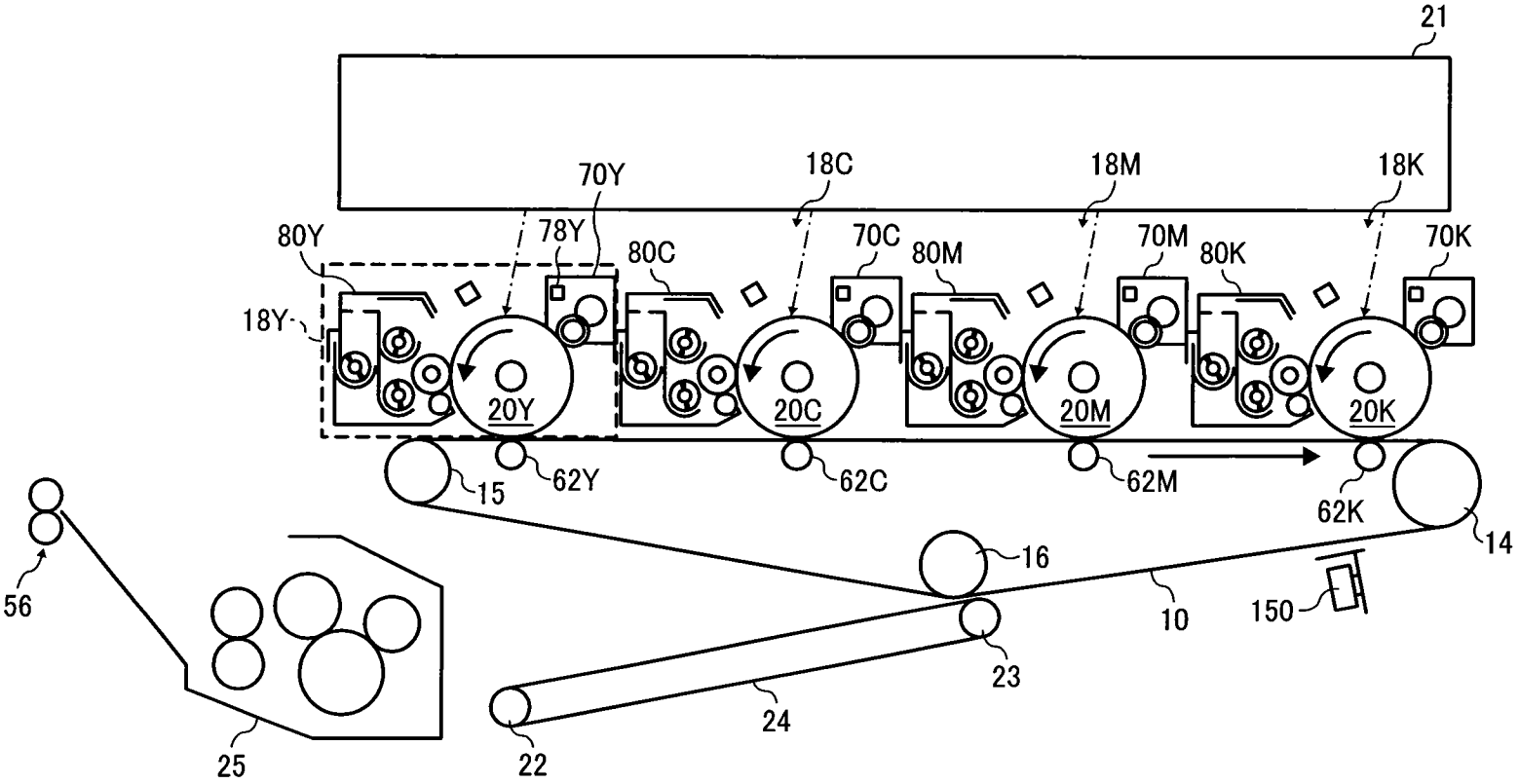
FIG. 2 is an enlarged view illustrating an image forming section of the copier of FIG. 1.

FIG. 2 is an enlarged view illustrating the image forming section 100 of FIG. 1. A transfer unit including an intermediate transfer belt 10, a transfer member in a form of an endless belt, is disposed in the image forming section 100. The intermediate transfer belt 10 of the transfer unit moves endlessly in a clockwise direction while being stretched around three support rollers 14, 15, and 16, one roller of which rotatably drives the intermediate transfer belt 10. In addition, four image forming units corresponding to the colors of yellow (Y), cyan (C), magenta (M), and black (K) are disposed opposite a surface of the intermediate transfer belt 10 moving between a first support roller 14 and a second support roller 15 among the support rollers 14, 15, and 16. An optical sensor unit 150 to detect an image density (that is, toner adhesion amount per unit area) of a toner image formed on the intermediate transfer belt 10 is disposed opposite the surface of the intermediate transfer belt 10 moving between the first support roller 14 and a third support roller 16.

As illustrated in FIG. 1, a laser writer 21 is disposed above image forming units 18Y, 18C, 18M, and 18K. The laser writer 21 emits writing light based on image information read by the scanner 300 or image information sent from an external personal computer. Specifically, a semiconductor laser is driven by the laser controller based on the image information and emits light that exposes and scans a surface of drum-shaped photoconductors 20Y, 20C, 20M, and 20K, each being a latent image bearer disposed in each of the image forming units 18Y, 18C, 18M, and 18K, thereby forming an electrostatic latent image on the photoconductors. The present light source employs a laser diode, but alternatively may employ a light-emitting diode (LED), for example.

Figure 3:
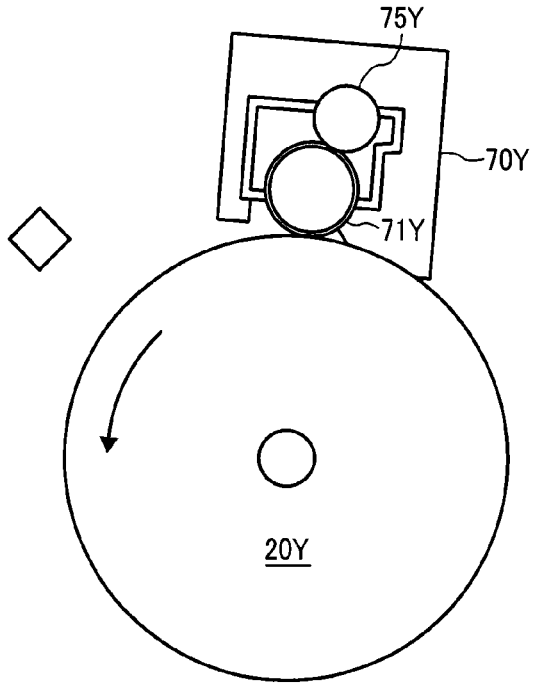
FIG. 3 is an enlarged view illustrating a photoconductor and a charger for Y-color in the image forming section of the copier of FIG. 1.

FIG. 3 is an enlarged view of the photoconductor 20Y and a charger 70Y each for yellow color. Parts and components for the Y-color will be described as a representative example. The charger 70Y includes a charging roller 71Y that contacts the photoconductor 20Y and rotates following a rotation of the photoconductor 20Y, a charge cleaning roller 75Y that contacts the charging roller 71Y and rotates following a rotation of the charging roller 71Y, and a photoconductor rotary sensor 76Y (simply, a rotary sensor 76Y, see FIG. 4) which will be described later.

Figure 4:
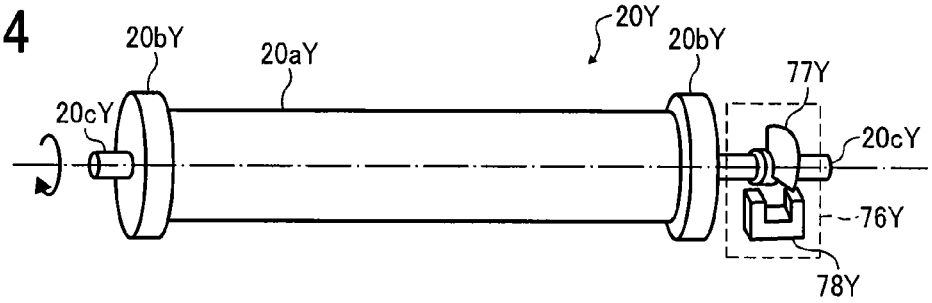
FIG. 4 is an enlarged perspective view illustrating the photoconductor of FIG. 3.

FIG. 4 is an enlarged view of the photoconductor 20Y for yellow color. The photoconductor 20Y includes a columnar main body 20*a*Y, large-diameter flanges 20*b*Y disposed at both ends of a main body 20*a*Y in a rotary shaft direction, and a rotary shaft 20*c*Y rotatably supported by a shaft bearing.

One end of the rotary shaft 20*c*Y that protrudes from each end of the two large-diameter flanges 20*b*Y passes through the rotary sensor 76Y, and the portion protruding from the rotary sensor 76Y is received by the shaft bearing. The rotary sensor 76Y includes a light shield 77Y that is secured to the rotary shaft 20*c*Y and rotates integrally with the rotary shaft 20cY, and a transmission-type photosensor 78Y. The light shield 77Y has a shape protruding in a normal line direction at a predetermined peripheral portion of the rotary shaft 20cY. When the photoconductor 20Y takes a predetermined rotary attitude, the light shield 77Y exists between a light emitting element and a light receiving element of the transmission-type photosensor 78Y. With this structure, when the light receiving element does not receive light, output voltage from the transmission-type photosensor 78Y greatly decreases. Specifically, the transmission-type photosensor 78Y detects that the photoconductor 20Y takes a predetermined rotary attitude, and greatly decreases the output voltage.

Figure 5:
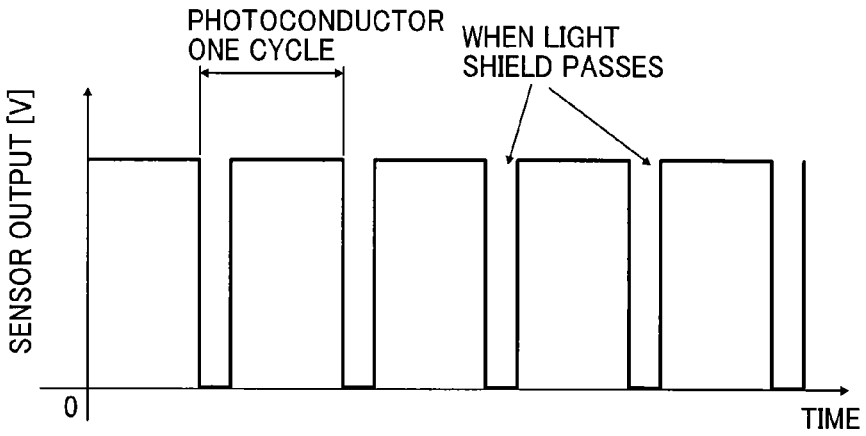
FIG. 5 is a graph showing a change over time in the output voltage from a rotary attitude sensor for Y-color in the image forming section of FIG. 3.

FIG. 5 is a graph showing a change over time in the output voltage from the rotary sensor 76Y for Y-color. More specifically, note that the output voltage from the rotary sensor 76Y is an output voltage from the transmission-type photosensor 78Y. As illustrated in FIG. 5, when the photoconductor 20Y rotates, voltage of 6 volts is output from the rotary sensor 76Y. However, each time the photoconductor 20Y rotates once, the output voltage from the rotary sensor 76Y drastically declines to near 0 volts instantaneously. This is because each time the charging roller 71Y rotates once, the light receiving element does not receive light due to the light shield 77Y existing between the light emitting element and the light receiving element of the transmission-type photosensor 78Y. Specifically, the output voltage greatly decreases at a timing when the photoconductor 20Y takes a predetermined rotary attitude. Hereinafter, the timing is called a reference attitude timing.

Referring back to FIG. 3, the charge cleaning roller 75Y of the charger 70Y includes a conductive metal core and an elastic layer coated on the peripheral surface of the metal core. The elastic layer is formed of a sponge material formed by minutely foaming melamine resins and rotates while contacting the charging roller 71Y. In the rotation, dust such as residual toner adhered on the charging roller 71Y is removed therefrom, thereby preventing abnormal images from being generated.

Referring back to FIG. 2, the four image forming units 18Y, 18C, 18M, and 18K are configured to be substantially similar to each other, except that each of the image forming units 18Y, 18C, 18M, and 18K handles a different color of toner. The image forming unit 18Y to form a Y-color toner image as an example includes the photoconductor 20Y, the charger 70Y, and a developing device 80Y.

The surface of the photoconductor 20Y is uniformly charged at a negative polarity by the charger 70. Potential of part of the uniformly charged surface of the photoconductor 20Y to which the laser light is emitted from the laser writer 21 is damped to be an electrostatic latent image.

Figure 6:
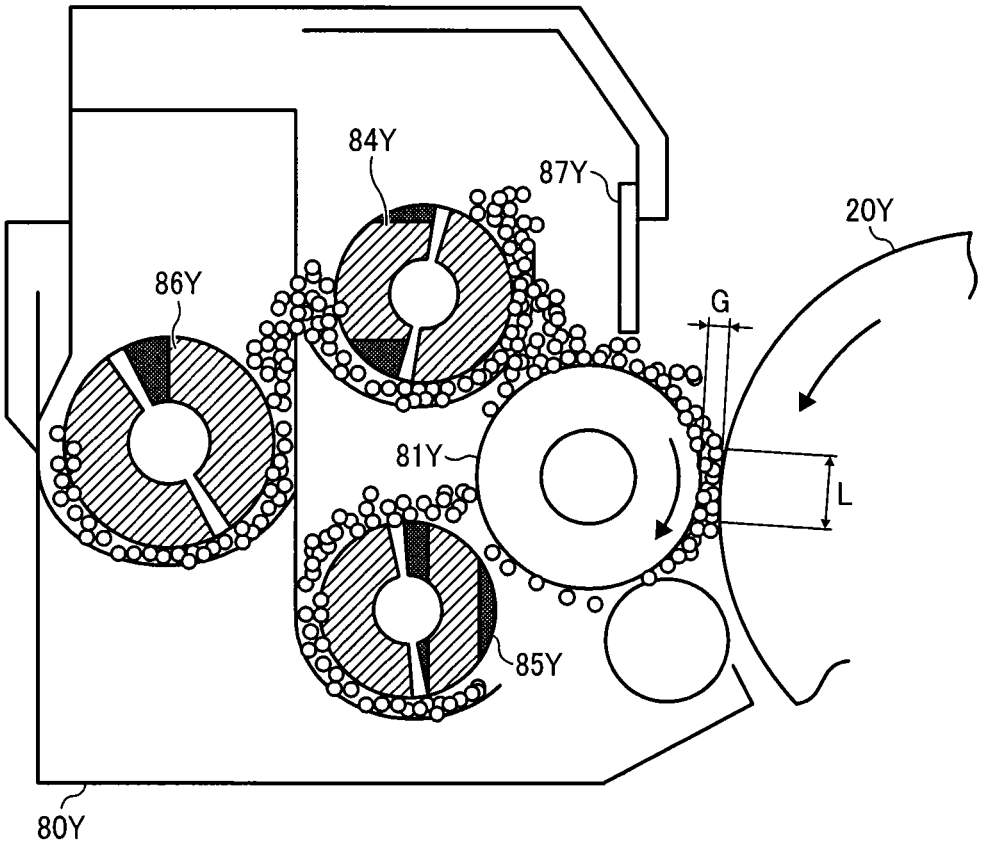
FIG. 6 schematically illustrates a developing device for Y-color and the photoconductor for Y-color in the image forming section of the copier of FIG. 1.

FIG. 6 schematically illustrates a developing device 80Y for Y-color and the photoconductor 20Y for Y-color. The developing device 80Y employs two-component developer including magnetic carriers and non-magnetic toner and performs two-component developing method; however, the developing device 80Y may employ one-component developer excluding magnetic carriers. The developing device 80Y includes an agitator section and a developing section housed within a development case. In the agitator section, the two-component developer (hereinafter, simply the developer) is agitated by three screws and is conveyed to the developing section.

The developing section includes a development sleeve 81Y that rotates while being opposite the photoconductor 20Y via an opening of the development case with a predetermined development gap G relative to the photoconductor 20Y. The development sleeve 81Y serving as a developer bearer includes a magnet roller, which does not rotate along with the development sleeve 81Y.

A supply screw 84Y and a collection screw 85Y in the agitator section, and the development sleeve 81Y in the developing section are disposed in parallel to each other in the attitude extending in the horizontal direction. In contrast, an agitation screw 86Y in the agitator section is disposed with a rising slope from a front side to a backside in the illustrated example.

The supply screw 84Y of the agitator section, while rotating, supplies the developer from the backside to the front side as illustrated in FIG. 6, and to the development sleeve 81Y of the developing section. The developer that is not supplied to the development sleeve 81Y and is conveyed to an end in the front side of the development case, falls on the collection screw 85Y disposed immediately below the supply screw 84Y.

The developer supplied to the development sleeve 81Y by the supply screw 84Y of the agitator section, is scooped up on a surface of the development sleeve 81Y by a magnetic force of the magnet roller included in the development sleeve 81Y. The developer scooped up on the surface of the development sleeve 81Y is brought to a magnetic brush state by the magnetic force of the magnet roller. A layer thickness of the magnetic brush on the development sleeve 81Y is regulated while passing through a regulation gap formed between a leading end of a regulation blade 87Y and the development sleeve 81Y, and then, the magnetic brush of the development sleeve 81Y is conveyed to a development area opposite the photoconductor 20Y.

In the development area, the developing bias applied to the development sleeve 81Y applies development potential to the toner opposed to the electrostatic latent image on the photoconductor 20Y among the toner present in the developer. The development potential applies static electricity toward the electrostatic latent image. In addition, the background potential of the photoconductor 20Y applies the toner opposed to the background portion on the photoconductor 20Y static electricity toward the surface of the sleeve. As a result, the toner transfers to the electrostatic latent image on the photoconductor 20Y, so that the electrostatic latent image is developed. Thus, a Y-toner image is formed on the photoconductor 20Y. The Y-toner image enters a primary transfer nip for Y-color following a rotation of the photoconductor 20Y.

The developer that has passed through the development area following the rotation of the development sleeve 81Y is conveyed to an area where the magnetic force of the magnet roller is weakened, separates from the surface of the development sleeve 81Y, and returns to the collection screw 85Y of the agitator section. The collection screw 85Y conveys the developer collected from the development sleeve 81Y from the backside to the front side in FIG. 6 along with the rotation thereof. The developer that has been conveyed to an end of the front side in the developing device is conveyed to the agitation screw 86Y.

The developer conveyed to the agitation screw 86Y from the collection screw 85Y is conveyed to the backside from the front side along with the rotation of the collection screw 85Y. During this process, the toner density is detected by a toner density sensor 82Y formed of a permeability sensor (to be described later referring to FIG. 7), and proper amount of toner is replenished based on the detection result. This replenishment is performed by a controller that drives a toner replenisher according to the readings from the toner density sensor. The developer to which an adequate amount of toner is replenished is conveyed to an end in the backside of the development case, and is received by the supply screw 84Y.

A development area length L, being a length of the sleeve rotation direction of the development area, changes due to a diameter of the development sleeve 81Y, the development gap G, and a regulation gap. As the development area length L lengthens, development performance increases because opportunities that the toner contacts the electrostatic latent image on the photoconductor 20Y increase in the development area. As a result, increasing the development area length L is preferable for a high-speed printing. However, if the development area length L is too long, possibility that certain defects such as toner dispersion, toner agglomeration, and photoconductor rotation lock, may be caused, increases. Thus, the development area length L needs to be set at a proper value in accordance with the properties of the apparatus.

Heretofore, formation of a Y-toner image in the image forming unit 18Y for Y-color has been described, and the other C-color, M-color, and K-color toner images can be formed on each surface of the photoconductors 20C, 20M, and 20K via similar processes as in the Y-color toner image, in each of the image forming units 18C, 18M, and 18K for the colors of C, M, and K.

As illustrated in FIG. 2, primary transfer rollers 62Y, 62C, 62M, and 62K for Y, C, M, and K are disposed inside the loop of the intermediate transfer belt 10. The intermediate transfer belt 10 is nipped or sandwiched between the primary transfer rollers 62Y, 62C, 62M, and 62K and the photoconductors 20Y, 20C, 20M, and 20K. With this nipping, an outer surface of the intermediate transfer belt 10 contacts each of the photoconductors 20Y, 20C, 20M, and 20K, respectively, thereby forming four primary transfer nips for Y-, C-, M-, and K-color. A primary electric field is formed between the primary transfer rollers 62Y, 62C, 62M, and 62K and the photoconductors 20Y, 20C, 20M, and 20K, respectively, to which the primary transfer bias is applied.

The outer surface of the intermediate transfer belt 10 sequentially passes the primary transfer nip for Y-, C-, M-, and K-color along an endless move of the belt. During such a process, Y-, C-, M-, and C-toner images on the photoconductors 20Y, 20C, 20M, and 20K are sequentially superimposed on the outer surface of the intermediate transfer belt 10 as a primary transfer. With this, a four-color superimposed toner image is formed on the outer surface of the intermediate transfer belt 10.

An endless conveyance belt 24 stretched over a first tension roller 22 and a second tension roller 23 is disposed below the intermediate transfer belt 10, and is driven to rotate in the counterclockwise direction according to a rotation of one of the tension rollers 22 and 23. The outer surface of the conveyance belt 24 contacts a portion of the intermediate transfer belt 10 at which the third support roller 16 is wound, so that a secondary transfer nip is formed. A secondary transfer electric field is formed between the grounded second tension roller 23 and the third support roller 16 to which the secondary transfer bias is applied, around the secondary transfer nip.

Referring back to FIG. 1, the image forming section 100 includes a conveyance path 48 to sequentially convey the recording sheet 5 fed from the sheet feed device 200 or the manual tray 6 to the secondary transfer nip, a fixing device 25 which will be described later, and to an ejection roller pair 56. Further, another conveyance path 49 is disposed to convey the recording sheet 5 conveyed from the sheet feed device 200 to the image forming section 100, to an entrance to the conveyance path 48. A registration roller pair 47 is disposed at the entrance to the conveyance path 48.

When a print job is started, the recording sheet 5 fed out from the sheet feed device 200 or the manual tray 6 is conveyed toward the conveyance path 48, and abuts the registration roller pair 47. The registration roller pair 47 starts rotation at a proper timing, thereby sending the recording sheet 5 toward the secondary transfer nip. The four-color superimposed toner image on the intermediate transfer belt 10 closely attaches to the recording sheet 5 at the secondary transfer nip. The four-color superimposed toner image on the intermediate transfer belt 10 is secondarily transferred en bloc onto the surface of the recording sheet 5 due to effects of secondary transfer electric field and nip pressure, so that a full-color toner image is formed on the surface of the recording sheet 5.

The recording sheet 5 that has passed through the secondary transfer nip is then conveyed to the fixing device 25 by the conveyance belt 24. The recording sheet 5 is pressed and heated inside the fixing device 25, so that a full-color toner image is fixed onto the surface of the recording sheet 5. Thereafter, the recording sheet 5 is discharged from the fixing device 25, is passed through the ejection roller pair 56, and is ejected onto the stack tray 7.

Figures 7, 7A:
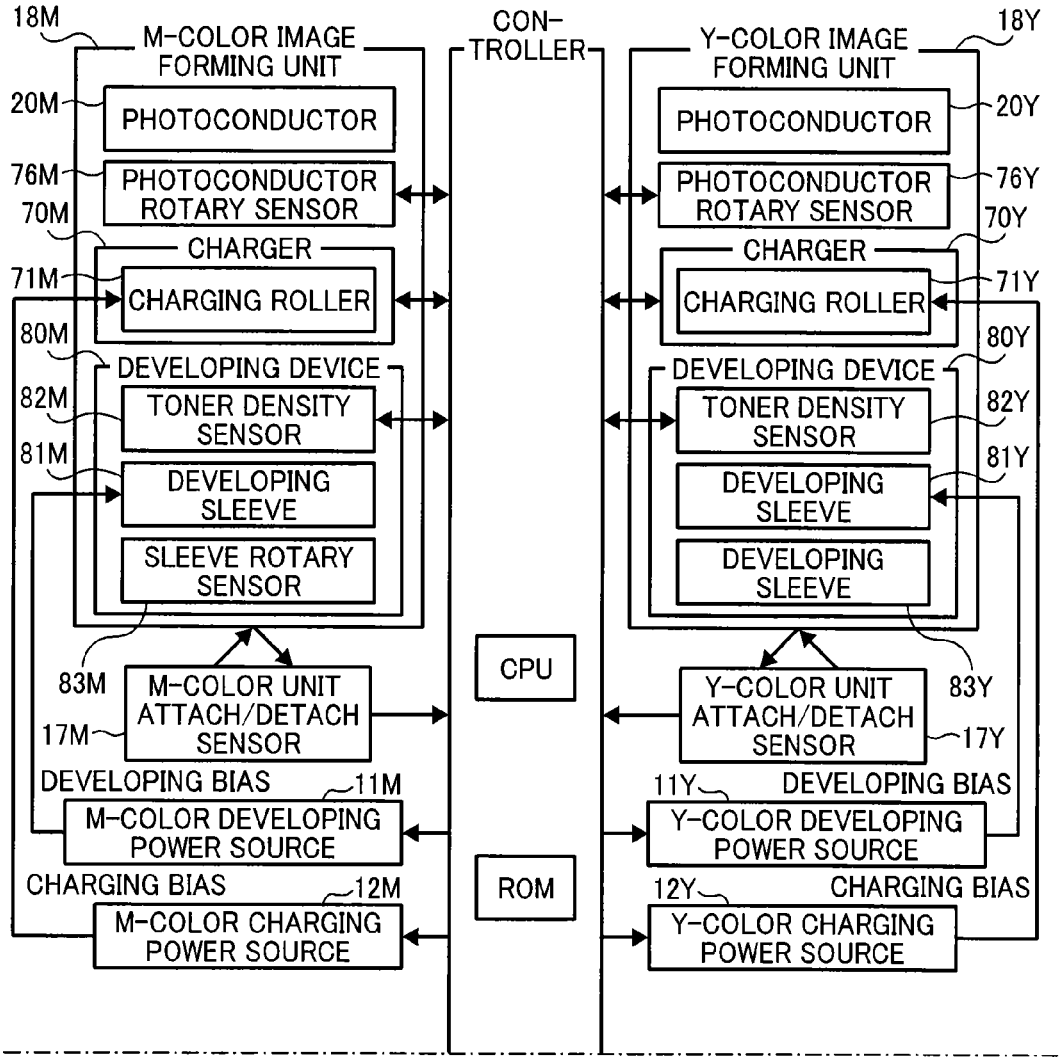
FIG. 7A and FIG. 7B (collectively referred to as FIG. 7) are a block diagram illustrating a principal part of electric circuit of the copier.
Figure 7B:
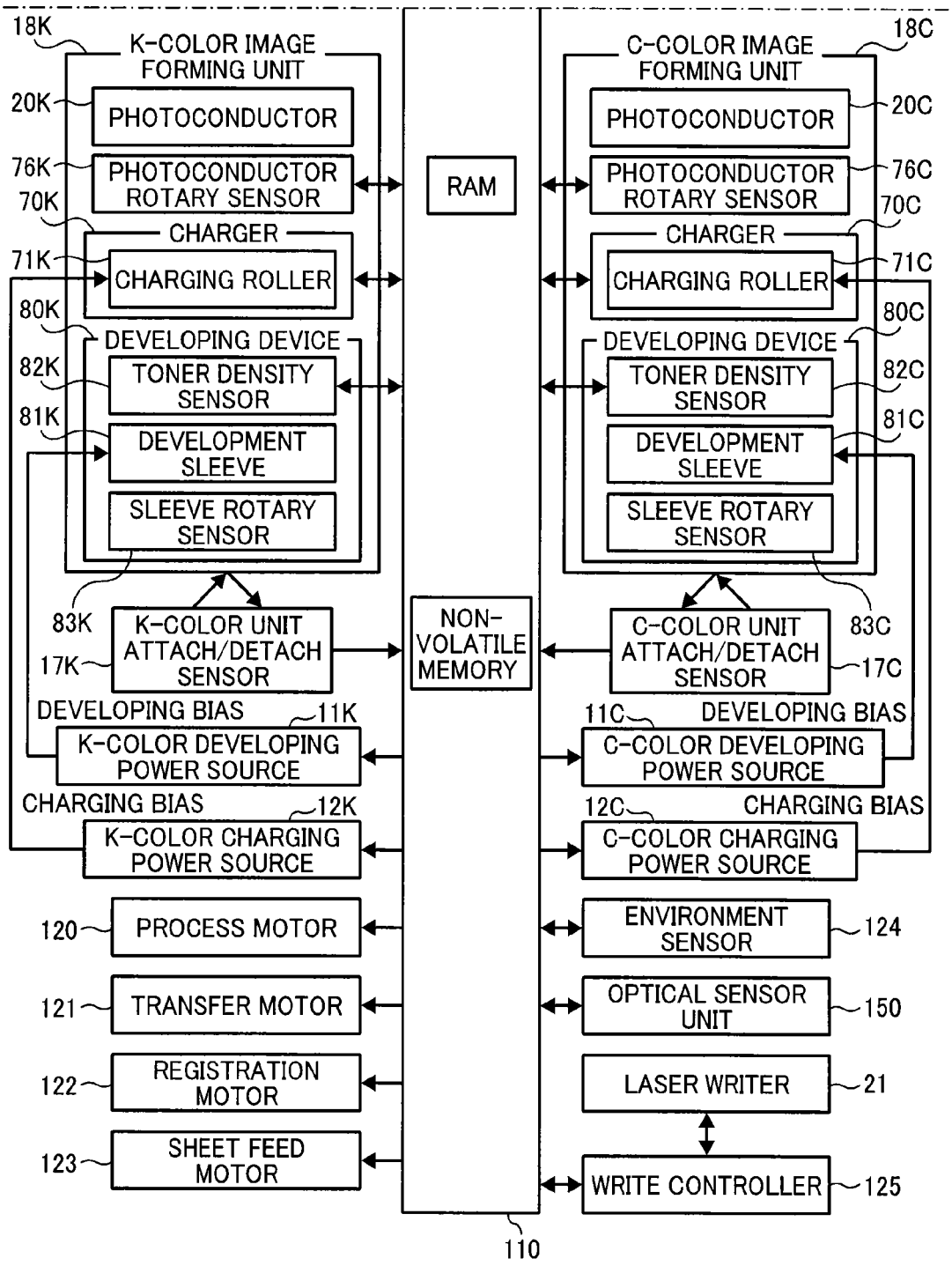

FIGS. 7A and 7B together forma block diagram illustrating a principal part of electronic circuitry of the copier. In the same figure, the controller 110 includes a CPU, a RANI, a ROM, a nonvolatile memory, and the like. The toner density sensors 82Y, 82C, 82M, and 82K of the Y-, C-, M-, and K-color developing devices 80Y, 80C, 80M, and 80K, respectively, are electrically connected to the controller 110. With this structure, the controller 110 obtains each toner density of the Y-developer, C-developer, M-developer, and K-developer contained in the developing devices 80Y, 80C, 80M, and 80K, respectively.

Y-, C-, M-, and K-color unit attach/detach sensors 17Y, 17C, 17M, and 17K are also electrically connected to the controller 110. The unit attach/detach sensors 17Y, 17C, 17M, and 17K detect whether or not any of the image forming units 18Y, 18C, 18M, and 18K, is attached to or detached from the image forming section 100. With this structure, the controller 110 recognizes that the image forming units 18Y, 18C, 18M, and 18K are attached to or detached from the image forming section 100.

In addition, Y-, C-, M-, and K-color developing power sources 11Y, 11C, 11M, and 11K are also electrically connected to the controller 110. Because the controller 110 outputs a control signal to each of the developing power sources 11Y, 11C, 11M, and 11K individually, the controller 110 can adjust an amount of the developing bias output from the developing power sources 11Y, 11C, 11M, and 11K, individually. Specifically, an amount of the developing bias to be applied to the Y-, C-, M-, and K-color development sleeves 81Y, 81C, 81M, and 81K can be individually adjusted.

In addition, Y-, C-, M-, and K-color charging power sources 12Y, 12C, 12M, and 12K are also electrically connected to the controller 110. Because the controller 110 outputs a control signal to each of the charging power sources 12Y, 12C, 12M, and 12K, respectively, the controller 110 can adjust an amount of direct current voltage in the charging bias output from the charging power sources 12Y, 12C, 12M, and 12K, individually. Specifically, the amount of direct current voltage in the charging bias to be applied to the Y-, C-, M-, and K-color charging rollers 71Y, 71C, 71M, and 71K can be individually adjusted.

In addition, the rotary sensors 76Y, 76C, 76M, and 76K each to detect whether or not the Y-, C-, M-, and K-color photoconductors 20Y, 20C, 20M, and 20K take a predetermined rotary attitude are also electrically connected to the controller 110. Accordingly, the controller 110 recognizes individually whether or not the Y-, C-, M-, and K-color rotary sensors 76Y, 76C, 76M, and 76K each take a predetermined rotary attitude, based on the output from the rotary sensors 76Y, 76C, 76M, and 76K.

Sleeve rotary sensors 83Y, 83C, 83M, and 83K of the Y-, C-, M-, and K-color developing devices 80Y, 80C, 80M, and 80K, respectively, are electrically connected to the controller 110. The sleeve rotary sensors 83Y, 83C, 83M, and 83K, each serving as a rotary attitude sensor, detect whether or not the Y-, C-, M-, and K-color development sleeves 81Y, 81C, 81M, and 81K each take a predetermined rotary attitude, with the structure similar to that of the rotary sensors 76Y, 76C, 76M, and 76K for photoconductor. Accordingly, the controller 110 recognizes individually whether or not the Y-, C-, M-, and K-color development sleeves 81Y, 81C, 81M, and 81K each take a predetermined rotary attitude, based on the output from the sleeve rotary sensors 83Y, 83C, 83M, and 83K.

In addition, a write controller 125, an environment sensor 124, an optical sensor unit 150, a process motor 120, a transfer motor 121, a registration motor 122, a sheet feed motor 123, and the like are also electrically connected to the controller 110. The environment sensor 124 detects temperature and humidity in the apparatus. The process motor 120 is a drive source of the image forming units 18Y, 18C, 18M, and 18K. The transfer motor 121 is a drive source of the intermediate transfer belt 10. The registration motor 122 is a drive source of the registration roller pair 47. In addition, the sheet feed motor 123 is a drive source of a pickup roller 202 that sends the recording sheet 5 from a sheet tray 201 of the sheet feed device 200. The write controller 125 controls driving of the laser writer 21 based on the image information. The role of the optical sensor unit 150 will be described later.

In the present copier, to stabilize the image density over a long time regardless of environmental changes, a process control is performed regularly at a predetermined interval. In the process control, first, Y-color patch pattern images including a plurality of patch-shaped Y-toner images are formed on the Y-color photoconductor 20Y, and transferred to the intermediate transfer belt 10. Each of the plurality of patch-shaped Y-toner images is a toner image for detecting a Y-toner adhesion amount. Similarly, the controller 110 forms C-, M-, and K-color patch pattern images on each of the photoconductors 20C, 20M, and 20K, and transfers those patch pattern images on the intermediate transfer belt 10 so as not to overlap each other. Then, the optical sensor unit 150 detects a toner adhesion amount of each toner image in the patch pattern images. Subsequently, based on the readings obtained, image forming conditions such as a developing bias reference value being a reference value of the developing bias Vb for each of the image forming units 18Y, 18C, 18M, and 18K are individually adjusted.

The optical sensor unit 150 includes four reflection-type photosensors disposed at predetermined intervals across the belt, that is, in the belt width direction of the intermediate transfer belt 10. Each reflection-type photosensor outputs a signal corresponding to an optical reflectance of the intermediate transfer belt 10 or of the patch-shaped toner image disposed on the intermediate transfer belt 10. Three of the four reflection-type photosensors receive both specular reflection light and diffusion reflection light on the surface of the belt so that these photosensors output signals corresponding to the Y-, M-, and C-toner adhesion amounts, and outputs signals corresponding to respective received light quantity.

Figure 8:
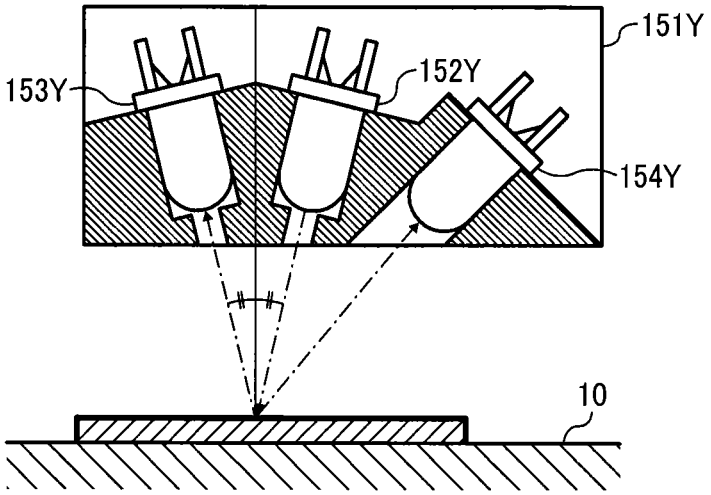
FIG. 8 is an enlarged view of a reflection-type photosensor for Y-color mounted on an optical sensor unit of the copier of FIG. 1.

FIG. 8 is an enlarged view of a reflection-type photosensor 151Y for Y-color mounted on the optical sensor unit 150. The reflection-type photosensor 151Y includes a light emitting diode (LED) 152Y as a light source, a light receiving element 153Y that receives the specular reflection light and a light receiving element 154Y that receives the diffused reflection light. The specular light receiving element 153Y outputs a voltage corresponding to a light amount of the specular reflection obtained on the surface of the Y-color patch-shaped toner image. The diffusion light receiving element 154Y outputs a voltage corresponding to a light amount of the diffusion reflection obtained on the surface of the Y-color patch-shaped toner image. The controller 110 calculates the Y-toner adhesion amount of the Y-color patch-shaped toner image based on the output voltages. Although the reflection-type photosensor 151Y for Y-color has been described, other reflection-type photosensors 151C and 151M for C-, and M-color are similarly configured.

Figure 9:
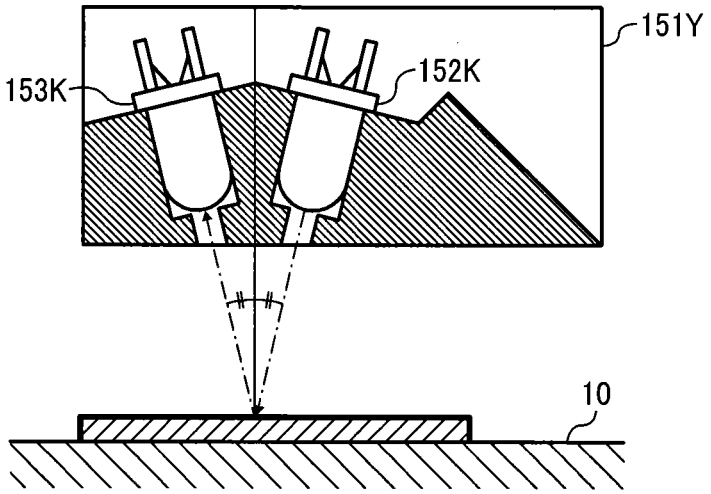
FIG. 9 is an enlarged view of a reflection-type photosensor for K-color mounted on the optical sensor unit of FIG. 8.

FIG. 9 is an enlarged view of a reflection-type photosensor 151K for K-color mounted on the optical sensor unit 150. The reflection-type photosensor 151K includes an LED 152K as a light source, and a light receiving element 153K that receives the specular reflection light. The specular light receiving element 153K outputs a voltage corresponding to a light amount of the specular reflection obtained on the surface of the K-color patch-shaped toner image. The controller 110 calculates the K-toner adhesion amount of the K-color patch-shaped toner image based on the output voltages.

In the present embodiment, each of the LEDs 152Y, 152C, 152M, and 152K employs a GaAs infrared light emitting diode having a peak wavelength 950 nm of the emitted light. The specular light receiving element (153Y, 153C, 153M, or 153K) and the diffusion light receiving element (154Y, 154C, or 154M) employ a Si photo transistor having a peak light receiving sensitivity of 800 nm. Alternatively, the peak wavelength and the peak light receiving sensitivity may be different from the above values.

There is a gap of approximately 5 millimeters between the four reflection-type photosensors and the outer surface of the intermediate transfer belt 10.

The controller 110 performs process control at a predetermined time interval such as a power-on time to a main power source, a standby time after a predetermined time has passed, and another standby time after a predetermined number of prints are output. When the process control is started, first, the controller 110 obtains environmental information such as number of prints, image coverage, temperature, and humidity, so that the controller 110 obtains individual development properties of the image forming units 18Y, 18C, 18M, and 18K. Specifically, the controller 110 calculates development $\gamma$ and development start voltage for each color. More specifically, the controller 110 allows the chargers 70Y, 70C, 70M, and 70K to uniformly charge, while rotating, each surface of the photoconductors 20Y, 20C, 20M, and 20K. In charging, the charging bias output from the charging power sources 12Y, 12C, 12M, and 12K is different from the output in normal printing. More specifically, among the direct current voltage and the alternating current voltage of the charging bias formed of superimposed bias, an absolute value of the direct current voltage is not constant, but gradually is increased. Using the photoconductors 20Y, 20C, 20M, and 20K charged by the above condition, the laser writer 21 scans with laser beams on each surface of the photoconductors 20Y, 20C, 20M, and 20K, so that a plurality of electrostatic latent images for each of the patch-shaped Y-, C-, M-, and K-toner images is formed. The thus-formed latent images are developed by the developing devices 80Y, 80C, 80M, and 80K, respectively, so that the Y-, C-, M-, and K-patch pattern images are formed on the photoconductors 20Y, 20C, 20M, and 20K, respectively. In the development, the controller 110 causes the absolute value of the developing bias to be applied to the Y-, C-, M-, and K-color development sleeves 81Y, 81C, 81M, and 81K to gradually increase. In this case, the electrostatic latent image potential in each patch-shaped toner image and a difference from the developing bias are stored in the RAM as development potential.

Figure 10:
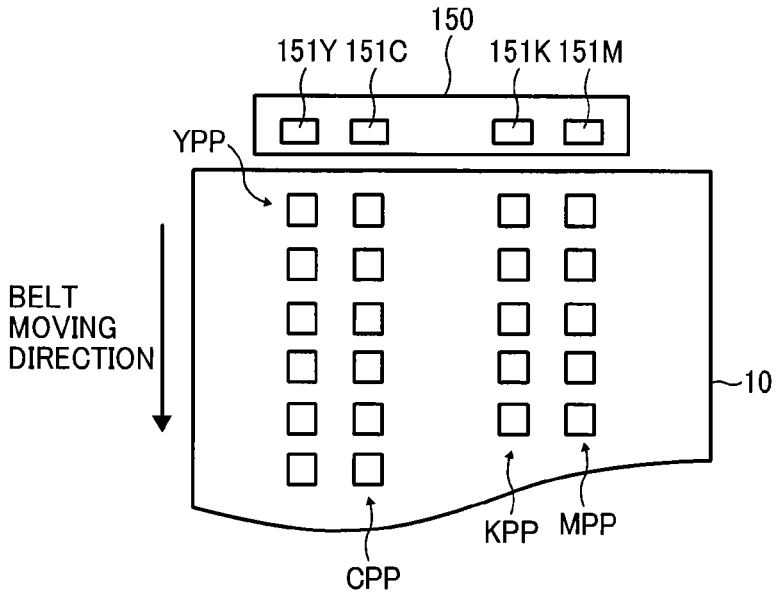
FIG. 10 illustrates a patch pattern for each color transferred to an intermediate transfer belt of the image forming section of the copier.

The Y-, C-, M-, and K-patch pattern images are arranged in the belt width direction so as not to overlap on the intermediate transfer belt 10 each other as illustrated in FIG. 10. Specifically, the Y-patch pattern image YPP is transferred to one end in the width direction of the intermediate transfer belt 10. Similarly, the C-patch pattern image CPP is transferred at a position shifted a little toward the center in the belt width direction than the YPP. In addition, the M-patch pattern image MPP is transferred to the other end in the width direction of the intermediate transfer belt 10. Further, the K-patch pattern image KPP is transferred at a position shifted a little toward the center in the belt width direction than the MPP.

The optical sensor unit 150 includes a Y-color reflection-type photosensor 151Y, a C-color reflection-type photosensor 151C, a K-color reflection-type photosensor 151K, and a M-color reflection-type photosensor 151M, each detecting light reflectivity of the belt at a different position in the belt width direction.

The Y-color reflection-type photosensor 151Y is disposed at a position to detect the Y-toner adhesion amount of the patch-shaped Y-toner image of the Y-patch pattern image YPP formed at the end of the intermediate transfer belt 10 in the belt width direction. The C-color reflection-type photosensor 151C is disposed at a position to detect the C-toner adhesion amount of the C-color patch-shaped toner image of the C-patch pattern image CPP formed near the Y-patch pattern image YPP in the belt width direction. The M-color reflection-type photosensor 151M is disposed at a position to detect the M-toner adhesion amount of the M-color patch-shaped toner image of the M-patch pattern image MPP formed at the other end in the width direction of the intermediate transfer belt 10. The K-color reflection-type photosensor 151K is disposed at a position to detect the K-toner adhesion amount of the K-color patch-shaped toner image of the K-patch pattern image KPP formed near the M-patch pattern image MPP in the belt width direction.

The controller 110 next calculates light reflectivity of the patch-shaped toner image of respective colors, based on the output signal sequentially sent from the four reflection-type photosensors of the optical sensor unit 150, obtains the toner adhesion amount based on the calculation result, and stores the obtained toner adhesion amount in the RAM. The patch pattern images of respective colors that have passed through the position opposite the optical sensor unit 150 along with the rotation of the intermediate transfer belt 10, are cleaned by the cleaning device from the outer surface of the belt.

Figure 11:
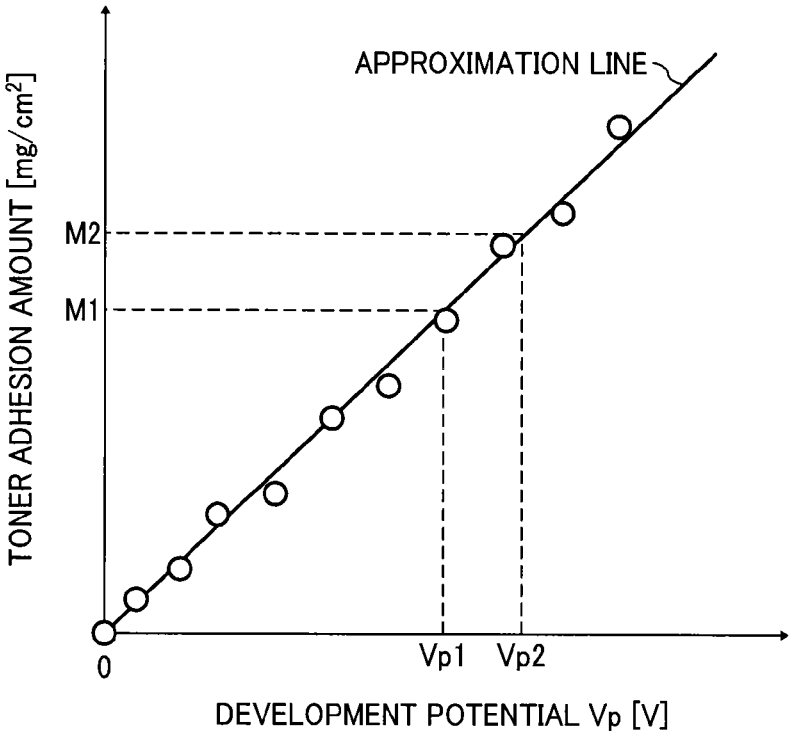
FIG. 11 is a graph of an approximation line showing a relation between a toner adhesion amount and a developing bias established by a process control.

The controller 110 calculates a linear approximation formula $Y=a\times Vp+b$, based on the toner adhesion amount stored in the RAM, and potential data of the latent image in each patch toner image and developing bias Vb data, stored in the RAM separately from the toner adhesion amount data. Specifically, as illustrated in FIG. 11, an approximation line represents a relation between the toner adhesion amount represented in Y-axis and the development potential represented in X-axis, in X-Y coordinate. The controller obtains a development potential Vp (e.g., Vp1 or Vp2 in FIG. 11) to achieve a target toner adhesion amount (e.g., M1 or M2 in FIG. 11) based on the approximation line, and further obtains a developing bias reference value and the charging bias reference value (and LD power) to achieve the development potential Vp. The obtained results are stored in the nonvolatile memory. The controller 110 performs calculation and storage of the developing bias reference value and the charging bias reference value (and LD power) for each color of Y, C, M, and K, and terminates the process control. Thereafter, the controller 110 causes the developing power sources 11Y, 11C, 11M, and 11K to output the developing bias Vb for each color of Y, C, M, and K, based on the developing bias reference value stored in the nonvolatile memory during the print job. In addition, the controller 110 causes the charging power sources 12Y, 12C, 12M, and 12K to output the charging bias Vd based on the charging bias reference value stored in the nonvolatile memory, and the laser writer 21 to output the LD power.

The controller 110 performs the process control as described above to determine the developing bias reference value, the charging bias reference value, and the optical write intensity (or LDP to be described later) to obtain a target toner adhesion amount, so that the image density of the whole image as to each color of Y, C, M, and K, can be stabilized over a long period. However, image density variation cyclically occurring in one image is caused due to variation in the development gap (hereinafter, to be referred to as a gap variation) between the photoconductors 20Y, 20C, 20M, and 20K and the development sleeves 81Y, 81C, 81M, and 81K.

The image density variation occurs in such a manner that the variations occurring due to the rotary cycle of the photoconductors 20Y, 20C, 20M, and 20K and due to the rotary cycle of the development sleeves 81Y, 81C, 81M, and 81K are superimposed. Specifically, when the rotary shaft of the photoconductors 20Y, 20C, 20M, and 20K is eccentric, the gap variation in a sine curve occurs at around one cycle of the photoconductor. With this, the development electric field formed between the photoconductors 20Y, 20C, 20M, and 20K and the development sleeves 81Y, 81C, 81M, and 81K exhibits electric field strength variation in the form of a sine curve formed at around one cycle of the photoconductor. As a result, due to the electric field strength variation, the image density variation in the form of the sine curve occurs at around one cycle of the photoconductor. In addition, the external shape of the photoconductor exhibits not a little distortion. Due to this distortion, the image density variation occurs due to a cyclical gap variation having a property of the same pattern at around one cycle of the photoconductor. Further, the cyclical image density variation occurs due to a gap variation in the sleeve rotary cycle because of eccentricity or distortion in the external shape of the development sleeves 81Y, 81C, 81M, and 81K. In particular, the image density variation due to the eccentricity or distortion in the external shape of the development sleeves 81Y, 81C, 81M, and 81K, each of which is relatively smaller than each of the photoconductors 20Y, 20C, 20M, and 20K, occurs at a relatively short cycle, so that the image density variation is more remarkable.

Then, the controller 110 performs output changing process as to each color or Y, C, M, and K in performing the print job, as follows. Specifically, the controller 110 stores output pattern data of the developing bias for each color of Y, C, M, and K, to cause the image density variation occurring at the photoconductor rotary cycle to be cancelled, in the nonvolatile memory. In addition, the controller 110 stores the development variation pattern data to cause the development electric field strength variation to be generated. The development electric field strength variation is capable of cancel out the image density variation occurring at the development sleeve rotary cycle. Hereinafter, the former development variation pattern data is called the development variation pattern data for the photoconductor cycle. The latter development variation pattern data is called the development variation pattern data for the sleeve cycle.

The four development variation pattern data for the photoconductor cycle each corresponding to each color of Y, M, C, and K is a pattern for one rotary cycle of the photoconductor, and represents a pattern with reference to the reference attitude timing of the photoconductors 20Y, 20C, 20M, and 20K. The development variation pattern data is used to change the output of the developing bias from the developing power sources (11Y, 11C, 11M, and 11K) based on the developing bias reference value for Y, C, M, and K determined through the process control. For example, if the data is the data table format data, the data group showing the developing bias output difference at a predetermined time interval is stored for a period of one cycle from the reference attitude timing. Leading data of the data group shows the developing bias output difference in the reference attitude timing, and a second, a third, a fourth to later data represent the developing bias output difference at a predetermined time interval. The output patterns formed of data group including 0, −5, −7, −9, . . . represent the developing bias output difference at each predetermined time interval set to 0[V], −5[V], −7[V], −9[V], . . . . To simply suppress the image density variation occurring at the photoconductor rotary cycle, the developing bias of the value in which the above value is superimposed on the developing bias reference value may be output from the developing power sources. However, in the present copier, to suppress the image density variation occurring at the development sleeve rotary cycle as well, the developing bias output difference to suppress the image density variation due to the photoconductor rotary cycle and the developing bias output difference to suppress the image density variation due to the development sleeve rotary cycle are superimposed.

The four development variation pattern data for the sleeve cycle each corresponding to each color or Y, M, C, and K is a pattern for one rotary cycle of the photoconductor, and represents a pattern with reference to the reference attitude timing of the development sleeves 81Y, 81C, 81M, and 81K. The development variation pattern data is used to change the output of the developing bias from the developing power sources (11Y, 11C, 11M, and 11K) based on the developing bias reference value for Y, C, M, and K determined through the process control as a reference value determination process. If the data is the data table format data, leading data of the data group shows the developing bias output difference in the reference attitude timing, and a second, a third, a fourth to later data represent the developing bias output difference at a predetermined time interval. The time interval is the same for the data group of the development variation pattern data for the photoconductor cycle.

The controller 110 reads data from the development variation pattern for the photoconductor cycle corresponding to each color of Y, C, M, and K at a predetermined time interval, in the image forming process. The controller 110 also reads data from the development variation pattern for the sleeve cycle corresponding to each color of Y, C, M, and K at a predetermined time interval, in the image forming process. In reading data, when the reference attitude timing does not come even after the data at the end of the data group has been read, the controller 110 reads data until the reference attitude timing arrives, and the read value is set to the same as that of the end data. In addition, when the reference attitude timing has come before the data at the end of the data group has been read, the data read position returns to the first data. As to reading data from the development variation pattern for the photoconductor cycle, a timing when the reference attitude timing signal is sent from the photoconductor rotary sensor 76Y, 76C, 76M, or 76K is set to a reference attitude timing. As to reading data from the development variation pattern for the sleeve cycle, a timing when the reference attitude timing signal is sent from the sleeve rotary sensor 83Y, 83C, 83M, or 83K is set to a reference attitude timing.

As to each color of Y, C, M, and K, in such a data reading process, the data read from the development variation pattern data for the photoconductor cycle and the development variation pattern data for the sleeve cycle are added and a superimposed value is obtained. For example, when the data read from the development variation pattern data for the photoconductor cycle is −(minus) 5 volts and the data read from the development variation pattern data for the sleeve cycle is 2 volts, −5 volts and 2 volts are added and the obtained superimposed value is −3 volts. When the developing bias reference value is −550 volts, −553 volts obtained by adding the superimposed value is caused to output from the developing power source. The aforementioned process is performed for each of Y-, C-, M-, and K-color at a predetermined time interval.

With this, an electric field strength variation that can cancel the electric field strength variation in which following two electric field strength variations are superimposed, is generated to the development field between the photoconductors 20Y, 20C, 20M, and 20K and the development sleeves 81Y, 81C, 81M, and 81K. The two variations are the electric field strength variation caused by a gap variation generated in the photoconductor rotary cycle due to eccentricity or distortion in the external shape of the photoconductors 20Y, 20C, 20M, and 20K, and the electric field strength variation caused by a gap variation generated in the sleeve rotary cycle due to eccentricity or distortion in the external shape of the development sleeves 81Y, 81C, 81M, and 81K. With this process, regardless of the rotary attitude of the photoconductors 20Y, 20C, 20M, and 20K and the development sleeves 81Y, 81C, 81M, and 81K, a substantially constant development electric field can be formed between the photoconductor 20 and the development sleeve 81. Thus, both the image density variation occurring in the photoconductor rotary cycle and the image density variation occurring in the sleeve rotary cycle can be suppressed.

The four development variation pattern data for the photoconductor cycle each corresponding to each color of Y, M, C, and K, and the four development variation pattern data for the sleeve cycle are configured at a predetermined timing. The predetermined timing includes an initial activation timing, that is, the timing before a first print job after shipment from the factory, and a replacement detection timing when a replacement of the image forming units 18Y, 18C, 18M, and 18K is detected. In the initial activation time, the development variation pattern data for the photoconductor cycle is formulated for each color of Y, C, M, and K. In addition, the development variation pattern data for the sleeve cycle is also formulated. In contrast, in the replacement detection timing, the development variation pattern data for the photoconductor cycle and the development variation pattern data for the sleeve cycle are formulated as to the image forming unit of which replacement is detected. To enable such a formulation, as illustrated in FIG. 7, unit attach/detach sensors 17Y, 17C, 17M, and 17K are disposed respectively to detect the replacement of each of the image forming units 18Y, 18C, 18M, and 18K.

Figure 12:
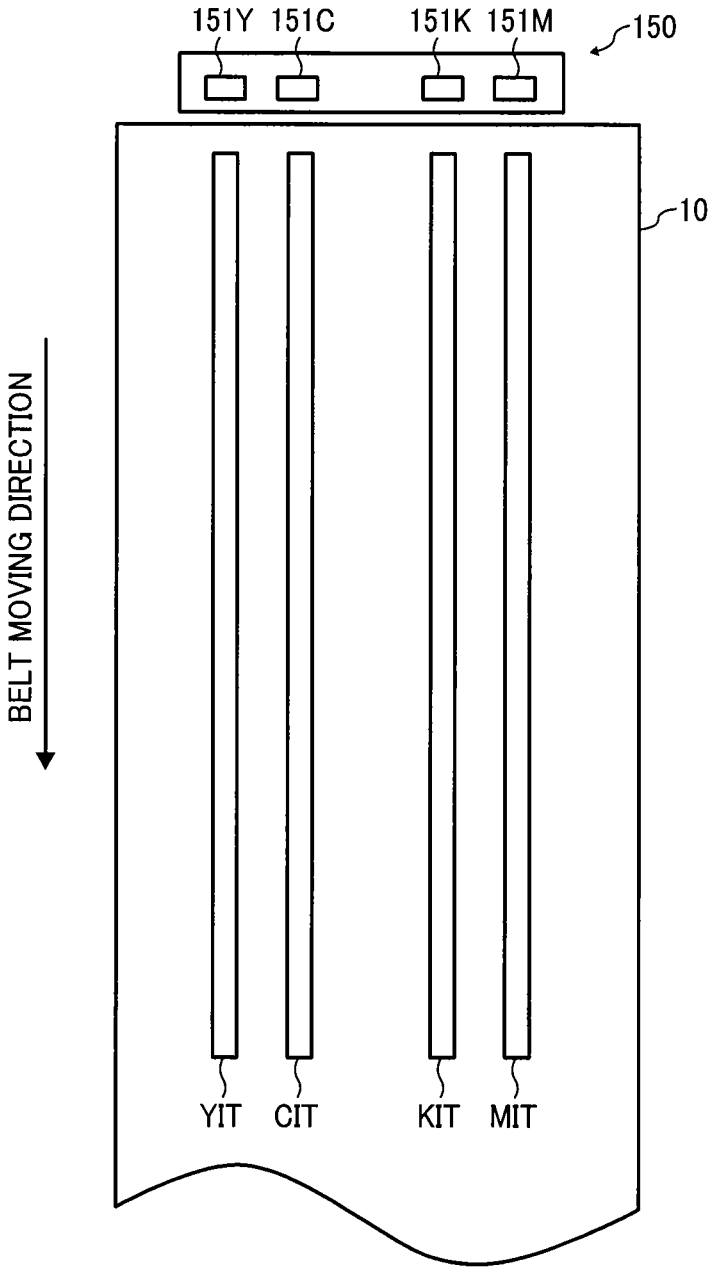
FIG. 12 is a schematic plan view of the intermediate transfer belt in the image forming section illustrating a toner image of each color for detecting each color solid density variation transferred to the intermediate transfer belt.

In the formulation process in the initial activation timing, first, a toner image formed of Y-solid toner image for detecting Y-solid density variation is formed on the photoconductor 20Y. In addition, toner images formed of C-, M-, and K-solid toner images for detecting C-, M-, and K-solid density variations are respectively formed on each of the photoconductors 20C, 20M, and 20K. Then, as illustrated in FIG. 12, those solid toner images for detecting the solid density variation are primarily transferred to the intermediate transfer belt 10. In the same figure, the Y-solid toner image YIT for detecting Y-solid density variation detects the image density variation generated in the rotary cycle of the photoconductor 20Y, so that the length of the YIT is longer than a circumferential length of the photoconductor 20Y in the belt direction of movement. Similarly, the C-solid toner image CIT for detecting C-solid density variation, the M-solid toner image MIT for detecting M-solid density variation, and the K-solid toner image KIT for detecting K-solid density variation each are longer than the circumferential length in the belt direction of movement of the photoconductors 20C, 20M, and 20K, respectively.

For simplification, FIG. 12 illustrates the four toner images (YIT, CIT, MIT, and KIT) for detecting the solid density variation which are formed in line in the belt width direction. However, in actuality, each position on the belt of the toner image for detecting the density variation may deviate in the belt direction of movement by a length corresponding to the photoconductor circumferential length at a maximum. This is because formation of the toner image for the solid density variation detection starts for each color such that a leading position of the toner image for the solid density variation detection and the reference position in the circumferential direction of the photoconductor (that is, the surface position of the photoconductor entering into the development area) are matched to each other. Specifically, each toner image for each color for detecting solid density variation is so formed as to match with the reference position in the circumferential direction of the photoconductor.

In the place of solid toner image, a halftone toner image may be employed as a toner image for detecting the density variation. For example, a halftone toner image having a dot coverage of 70% can be formed.

The controller 110 performs both the formulation process and the process control in parallel. Specifically, immediately before performing the formulation process, the controller 110 performs the process control to determine the developing bias reference value for each color of Y, C, M, and K. Then, in the formulation process performed immediately after the process control, the toner image for detecting the solid density variation is developed under the condition of the developing bias reference value determined in the process control. As a result, in theory, the toner image for detecting the solid density variation is image-formed so as to attain the target toner adhesion amount; however, in reality, minute density variation appears due to the development gap variation.

A time lag between a start of image formation of the toner image for detecting the solid density variation, that is, after having started the writing of the electrostatic latent image and an entry of the leading end of the toner image for detecting the solid density variation into the detection position by the reflection-type photosensor of the optical sensor unit 150 is different from color to color. However, the time lag is constant over time for the same color (hereinafter, this time lag is called a writing-detection time lag).

The controller 110 previously stores the writing-detection time lag for each color in the nonvolatile memory. For each color, after image formation of the toner image for detecting solid density variation, from the time when the writing-detection time lag elapsed, sampling of the output from the reflection-type photosensor is started. The sampling is repeated over one rotary cycle of the photoconductor at a predetermined time interval. The time interval is the same time interval for reading each data in the output pattern data used for the output change process. The controller 110 formulates, based on the sampling data, a density variation graph for each color that represents a relation between a toner adhesion amount (or an image density) and a time period (or the photoconductor surface position), and extracts two solid density variation pattern from the density variation graph. One is the solid density variation pattern occurring in the photoconductor rotary cycle. Second is the solid density variation pattern occurring in the development sleeve rotary cycle.

The controller 110 extracts the solid density variation pattern generated in the photoconductor rotary cycle based on the sampling data for each color, and calculates an average toner adhesion amount (or an average image density). The average toner adhesion amount substantially reflects an average of the variation in the development gap in one rotary cycle of the photoconductor. The controller 110 formulates, based on the average toner adhesion amount, a photoconductor cycle output pattern data to cancel the solid density variation pattern of the photoconductor rotary cycle. Specifically, the controller 110 calculates bias output differences each corresponding to each of the plurality of toner adhesion amount data included in the solid density variation pattern. The bias output difference is based on the average toner adhesion amount. Specifically, the controller 110 calculates the bias output difference corresponding to the toner adhesion amount data with a same amount as that of the average toner adhesion amount as zero.

In addition, the controller 110 calculates the bias output difference corresponding to the toner adhesion amount data that is larger than the average toner adhesion amount as a value of plus polarity corresponding to the difference between the toner adhesion amount and the average toner adhesion amount. The bias output difference of the plus polarity is the data to change the minus polarity developing bias to a smaller value (i.e., a smaller absolute value) than the developing bias reference value.

In addition, the controller 110 calculates the bias output difference corresponding to the toner adhesion amount data that is smaller than the average toner adhesion amount as a value of minus polarity corresponding to the difference between the toner adhesion amount and the average toner adhesion amount. The bias output difference of the minus polarity is the data to change the minus polarity developing bias to a greater value (i.e., a greater absolute value) than the developing bias reference value.

The thus-obtained bias output differences corresponding to respective toner adhesion amount data are sequentially arranged and are formulated as a photoconductor cycle output pattern data.

The controller 110 extracts a density variation pattern generated in the development sleeve rotary cycle based on the sampling data for each color, and calculates an average toner adhesion amount (or an average image density). The average toner adhesion amount substantially reflects an average of the variation in the development gap in one rotary cycle of the development sleeve. The controller 110 formulates, based on the average toner adhesion amount, a sleeve cycle output pattern data to cancel the solid density variation pattern of the development sleeve rotary cycle, in the same manner when the controller 110 formulates the photoconductor cycle output pattern data to cancel the density variation pattern of the photoconductor cycle.

Figure 13:
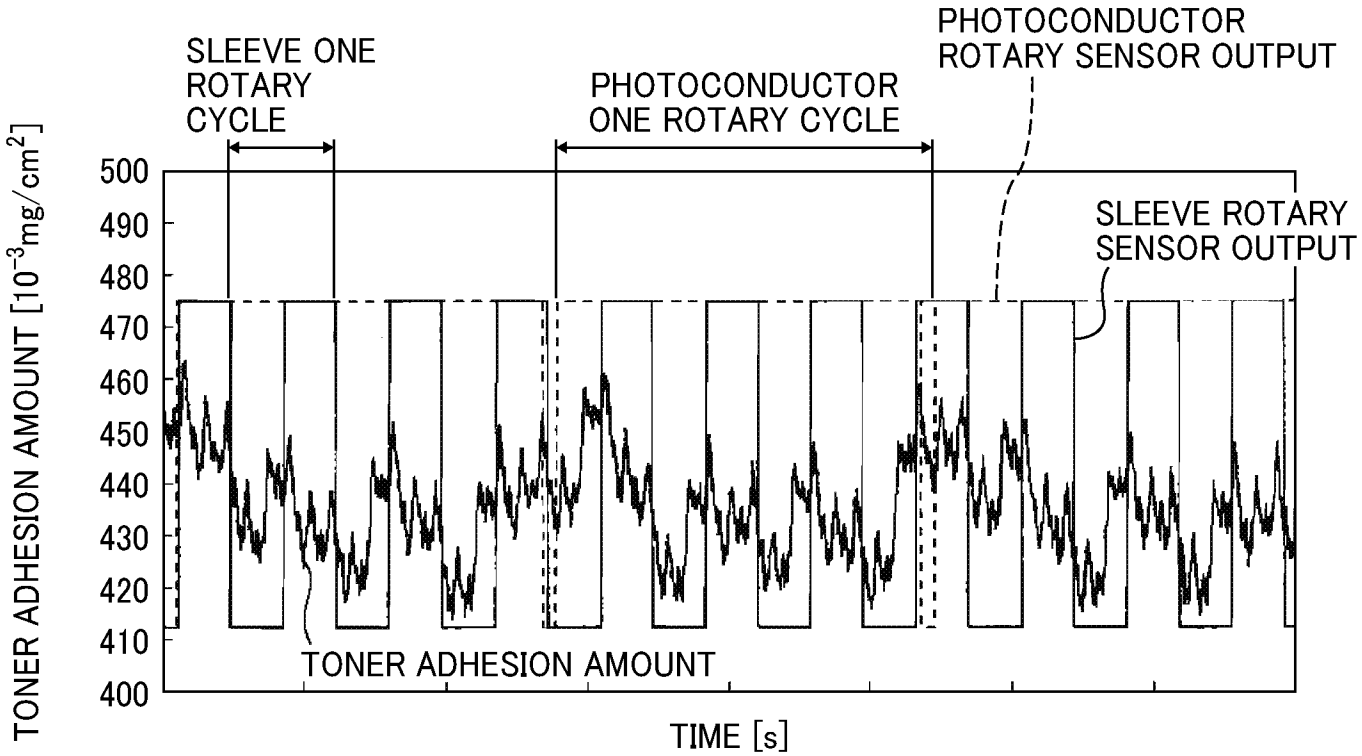
FIG. 13 is a graph illustrating a relation between a cyclic variation in a toner adhesion amount of the toner image for detecting a solid density variation, a sleeve rotary sensor output, and a photoconductor rotary sensor output.

FIG. 13 is a graph illustrating a relation between cyclical variation in a toner adhesion amount of the toner image for detecting a solid density variation, a sleeve rotary sensor output, and a photoconductor rotary sensor output. The vertical axis of the graph represents a toner adhesion amount [$10^{-3}$ mg/cm$^2$], which is a value converted from the output voltage from the reflection-type photosensor 151 of the optical sensor unit 150 to a toner adhesion amount based on a predetermined conversion formula. It is understood that a cyclical density variation in the intermediate transfer belt direction of movement is generated in the toner image for detecting the solid density variation.

Figure 14:
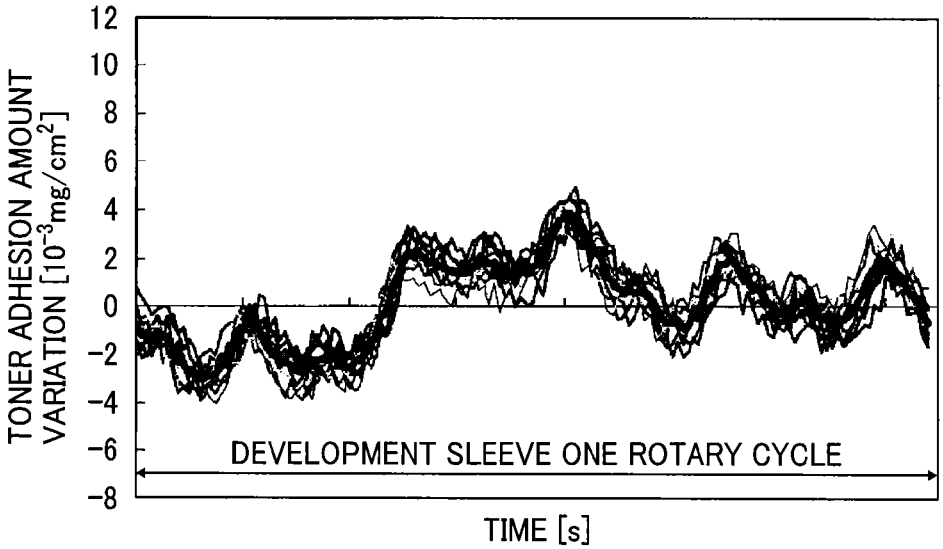
FIG. 14 is a graph illustrating an average waveform.

In formulating the development variation data for the sleeve cycle, first, in order to remove the cyclic variation component different from the sleeve cycle, the toner adhesion amount data over time is taken at each rotary cycle of the sleeve and an averaging process is performed. More specifically, the length of the toner image for detecting the solid density variation corresponds to ten times or more of the development sleeve circumferential length, so that the toner adhesion amount change data over time is obtained over ten cycles or more of the development sleeve. The changing waveform based on the data is cut out for one cycle of the sleeve with the sleeve reference attitude timing set at a head. With this, upon obtaining ten cutout waveforms, the cutout waveforms are superimposed such that the sleeve reference attitude timing is synchronized as illustrated in FIG. 14, and the averaging process is performed to analyze the average waveform. The average waveform obtained by averaging ten cutout waveforms is shown by a bald line in FIG. 14. Each cutout waveform includes different cyclic change components different from the sleeve rotary cycle which is not smooth, but the average waveform includes reduced variations. In the present copier according to the present embodiment, averaging is performed as to ten cutout waveforms; however, another method may be formed as long as the sleeve rotary cycle variation components can be extracted.

Figure 15:
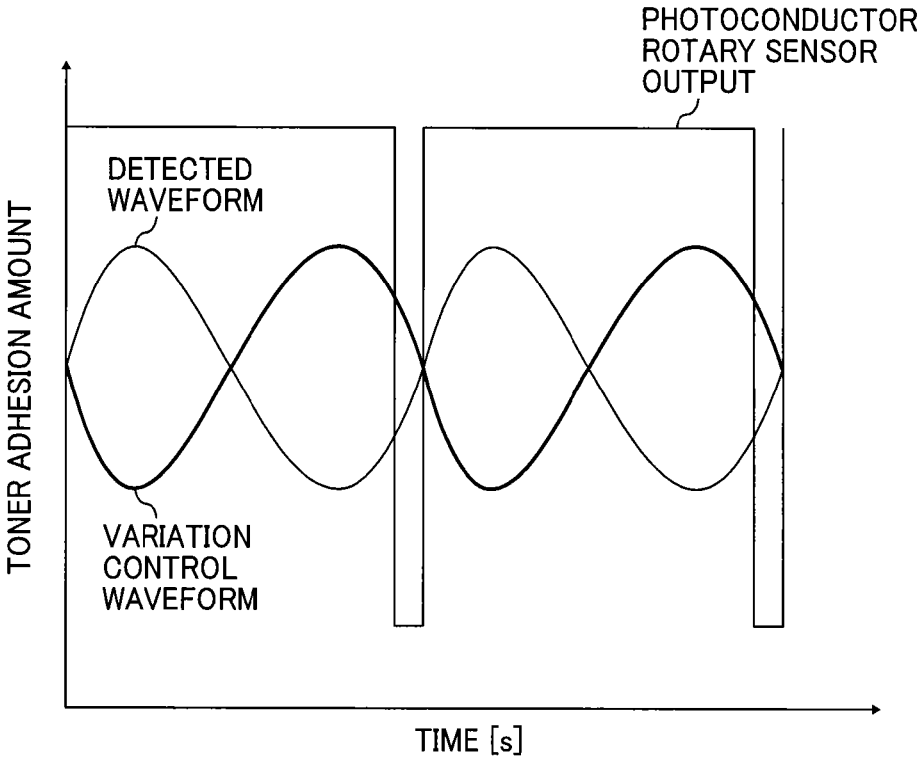
FIG. 15 is a graph illustrating a principle of algorithm for use in formulating a development variation pattern data.

In the present copier, similarly to the development variation data for the sleeve cycle, the development variation data for the photoconductor cycle is subject to the averaging process using the cutout waveforms cutout by one rotary cycle of the photoconductor, and formulates the photoconductor cycle output pattern data based on the averaged data. Formulation of the development change data based on the average waveform is performed using a following algorithm by converting the toner adhesion amount to a developing bias change amount. Specifically, as illustrated in FIG. 15, such an algorithm causes a developing bias change that applies change control waveform with a reverse phase relative to the detected waveform of the toner adhesion amount, to be generated.

Figure 16:
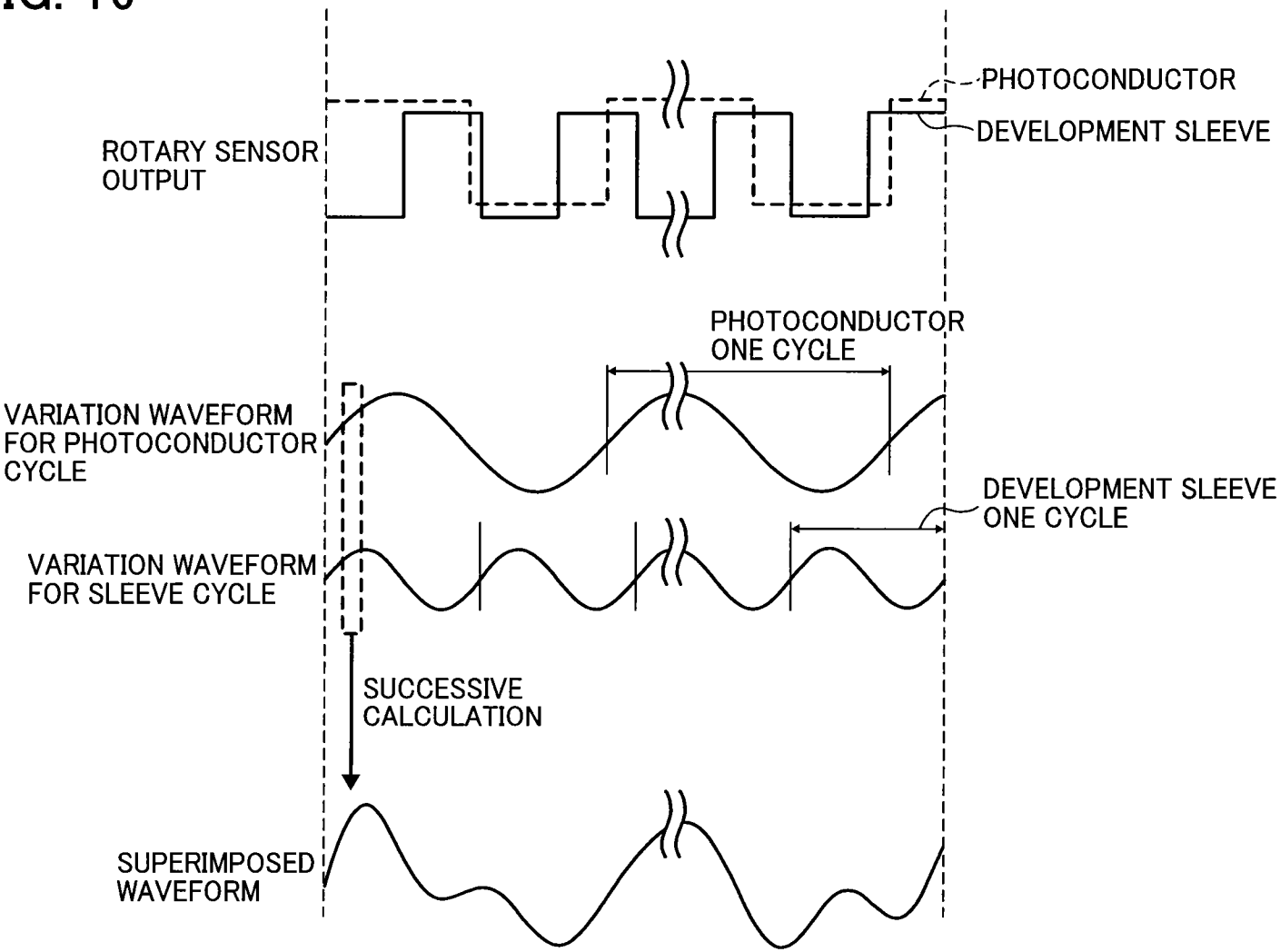
FIG. 16 is a timing chart illustrating each output timing in image formation.

As described above, for each color, using the photoconductor cycle output pattern data and the sleeve cycle output pattern data formulated in the formulation process, output from the developing power sources 11Y, 11C, 11M, and 11K of the developing bias Vb is changed in the output change process. More specifically, as illustrated in FIG. 16, the developing bias is cyclically changed in accordance with the superimposed waveform in which the developing bias change waveform due to the development variation pattern data for the photoconductor cycle and the developing bias change waveform by the development variation pattern data for the sleeve cycle are superimposed. Thus, both the image density variation occurring in the photoconductor rotary cycle and the image density variation occurring in the development sleeve rotary cycle can be suppressed.

In an image in which the solid portion and the halftone portion coexist, the solid portion image density is greatly affected by the developing potential being a difference between the developing bias Vb and the latent image potential V1 being a potential of the electrostatic latent image. By contrast, the image density of the halftone portion may be affected more by the background potential being a difference between the background potential Vd of the photoconductor and the developing bias Vb. The reason is as follows. Specifically, in the solid portion, peripheral portions of all the dots are overlapped. Specifically, there is no isolation dots. By contrast, in the halftone portion, there are isolation dots, and groups of dots including a small number of dots exist. Those isolation dots or groups of a small number of dots are more susceptible to an edge effect than the solid portion. As a result, under the condition of background potential similar to the solid portion, an adhesive force on the photoconductor is stronger in the halftone portion than in the solid portion and is hard to receive effect from the gap variation. Further, the toner adhesion amount per unit area is greater in the halftone portion than the solid portion, and the toner adhesion amount variation amount due to the gap variation in the halftone portion becomes less compared to the toner adhesion amount variation amount of the solid portion. When the developing bias Vb is changed by the superimposed output pattern formulated based on the density variation pattern of the toner image for detecting the density variation, the image density variation can be suppressed in the solid portion, but the image density variation in the halftone portion is subjected to excessive correction. Due to the excessive correction, the image density variation is generated in the halftone portion.

The edge effect is heavily influenced by the background potential. Then, by adjusting the background potential, the above-described excessive correction can be corrected. To change the background potential, the background potential Vd may be changed by changing the charging bias. Even though the background potential Vd is changed, the development potential can be maintained substantially constant. For example, suppose that the background potential Vd is changed to −1000 volts or −1200 volts under the conditions of the normal background potential Vd is −1100 volts, the developing bias Vb is −700 volts, and the latent image potential Vl is −50 volts, if the necessity arises. Even though the background potential Vd is changed, the latent image potential Vl can be maintained at substantially constant −50 volts, regardless of the background potential Vd, if the latent image write intensity is set in such a range that the saturation exposure potential of around −50 volts can be obtained. As a result, even though the background potential is changed by changing the background potential Vd, because the development bias Vb can be kept constant, the image density of the solid portion does not receive any effect.

Then, the controller 110 formulates a charge variation pattern for the photoconductor cycle and the charge variation pattern for the sleeve cycle in addition to the development variation pattern for the photoconductor cycle and the development variation pattern for the sleeve cycle, for each of the color of Y, C, M, and K in the above formulation process. Specifically, after formulating the development variation pattern, a toner image formed of Y-halftone toner image for detecting Y-halftone density variation is formed on the photoconductor 20Y. In addition, a toner image formed of C-halftone toner image for detecting C-halftone density variation is formed on the photoconductor 20C; a toner image formed of M-halftone toner image for detecting M-halftone density variation is formed on the photoconductor 20M; and a toner image formed of K-halftone toner image for detecting K-halftone density variation is formed on the photoconductor 20K. When those toner images for detecting the density variation are formed, the developing bias Vb is changed due to the developing bias reference value, the development variation pattern for the photoconductor cycle, the photoconductor reference attitude timing, the development variation pattern for the sleeve cycle, and the sleeve reference attitude timing. In the above condition, the image density variation in the photoconductor rotary cycle and the sleeve rotary cycle in the solid portion can be suppressed; however, because the above four toner image for detecting density variation is formed of halftone toner image, the image density variation occurs due to the excessive correction of the developing bias Vb. To detect the image density variation, the controller 110 samples outputs from the four reflection-type photosensors of the optical sensor unit 150 at a predetermined time interval for a time period of more than one cycle of the photoconductor.

Thereafter, the controller 110 extracts the density variation pattern occurring in the photoconductor rotary cycle based on the sampling data obtained for each color. The controller 110 calculates an average toner adhesion amount (or an average image density) of the toner image for detecting the density variation based on the density variation pattern. Thereafter, as to the halftone portion, the controller 110 formulates, based on the average toner adhesion amount, a charge variation pattern data as an output change pattern of the photoconductor cycle of the charging bias to cancel the density variation pattern of the photoconductor rotary cycle. Specifically, the controller 110 calculates bias output differences each corresponding to each of the plurality of toner adhesion amount data included in the density variation pattern. The bias output difference is based on the average toner adhesion amount. The controller 110 calculates the bias output difference corresponding to the toner adhesion amount data with a same amount as that of the average toner adhesion amount as zero. In addition, the controller 110 calculates the bias output difference corresponding to the toner adhesion amount data that is larger than the average toner adhesion amount as a value of plus polarity corresponding to the difference between the toner adhesion amount and the average toner adhesion amount. The bias output difference of the plus polarity is the data to change the minus polarity developing bias to a smaller value (i.e., a smaller absolute value) than the developing bias reference value. In addition, the controller 110 calculates the bias output difference corresponding to the toner adhesion amount data that is smaller than the average toner adhesion amount as a value of minus polarity corresponding to the difference between the toner adhesion amount and the average toner adhesion amount. The bias output difference of the minus polarity is the data to change the minus polarity developing bias to a larger value (i.e., a larger absolute value) than the developing bias reference value.

The thus-obtained bias output differences corresponding to respective toner adhesion amount data are sequentially arranged and are formulated as a charge variation pattern for the photoconductor cycle.

The controller 110 extracts a density variation pattern generated in the development sleeve rotary cycle based on the sampling data for each color, and calculates an average toner adhesion amount (or an average image density). The controller 110 formulates, based on the average toner adhesion amount, the charge variation pattern data for the sleeve cycle as a sleeve cycle output pattern data for the charging bias to cancel the density variation pattern of the development sleeve rotary cycle. Specifically, the controller 110 performs the formulation process of the charge variation pattern data in the similar manner that the charge variation pattern data for the photoconductor cycle is formulated.

Upon the charge variation pattern data is formulated as above, an order of each data included in the charge variation pattern for the photoconductor cycle is shifted by a predetermined number. Specifically, the leading data in the development variation pattern data for the photoconductor cycle corresponds to a position, among the whole area in the circumference of the photoconductor, that the photoconductor enters the development area when the photoconductor is brought to a reference rotary attitude. The position is not charged by the development area, but is charged at a contact area by the charging roller (71Y, 71C, 71M, and 71K) and the photoconductor (20Y, 20C, 20M, and 20K). Because there is a time lag between the contact area and the development area, the position of each data is shifted by the predetermined number that corresponds to the time lag. For example, when the pattern data is formed of 250 data, positions of the first to 230th data each are shifted by 20, and the 231st data to the 250th data are made as the first to 20th data. Similarly, as to the charge variation pattern data for the sleeve cycle, each data position is shifted by a predetermined number.

When an image is formed in response to a command from a user, outputs of the developing bias Vb from the developing power sources are changed based on the development variation pattern data for the photoconductor cycle and the development variation pattern data for the sleeve cycle formulated in the formulation process, for each color. Specifically, the controller 110 formulates a superimposed output pattern data (that is, the data for reproducing the superimposed waveform) based on the development variation pattern data for the photoconductor cycle, the photoconductor reference attitude timing, the development variation pattern data for the sleeve cycle, and the sleeve reference attitude timing. Then, based on the superimposed output pattern data and the developing bias reference value, the output value of the developing bias Vb is changed. Thus, the image density variation in the solid portion occurring in the photoconductor rotary cycle and the sleeve rotary cycle can be suppressed.

Thus, in parallel with changing the developing bias, the outputs of the charging bias from the charging power source can be changed based on the charge variation pattern data for the photoconductor cycle and for the sleeve cycle formulated in the formulation process. Specifically, the controller 110 formulates a superimposed output pattern data based on the development variation pattern data for the photoconductor cycle, the photoconductor reference attitude timing, the development variation pattern data for the sleeve cycle, and the sleeve reference attitude timing. Then, based on the superimposed output pattern data and the charging bias reference value as a reference value determined by the process control, the output of the charging bias from the charging power source is changed. Thus, the image density variation in the halftone portion occurring in the photoconductor rotary cycle and the sleeve rotary cycle caused by the excessive correction of the developing bias Vb can be suppressed.

Next, a description will be given of a structure of the copier according to the present embodiment.

Even though the output of the charging bias is cyclically changed based on the charge variation pattern data, a cyclical density variation may be occurred in the halftone portion. Such density variation is hereinafter called a residual cyclic variation. The residual cyclic variation can be suppressed by changing the latent image write intensity by the laser writer 21, that is, by changing the writing light quantity cyclically in addition to cyclically changing the developing bias and the charging bias.

Accordingly, in the present copier, when an image is formed based on the command from the user, the controller 110 and the write controller 125 are used in combination so that the writing light quantity of the latent image is changed cyclically in addition to cyclically changing the developing bias and the charging bias. Due to this structure, the residual cyclic variation can be suppressed more effectively.

Next, a first embodiment of the copier according to the present invention will be described. Unless specified in particular, a schematic structure of the copier according to each embodiment is identical with the copier as described heretofore.

[First Embodiment]

Figure 17:
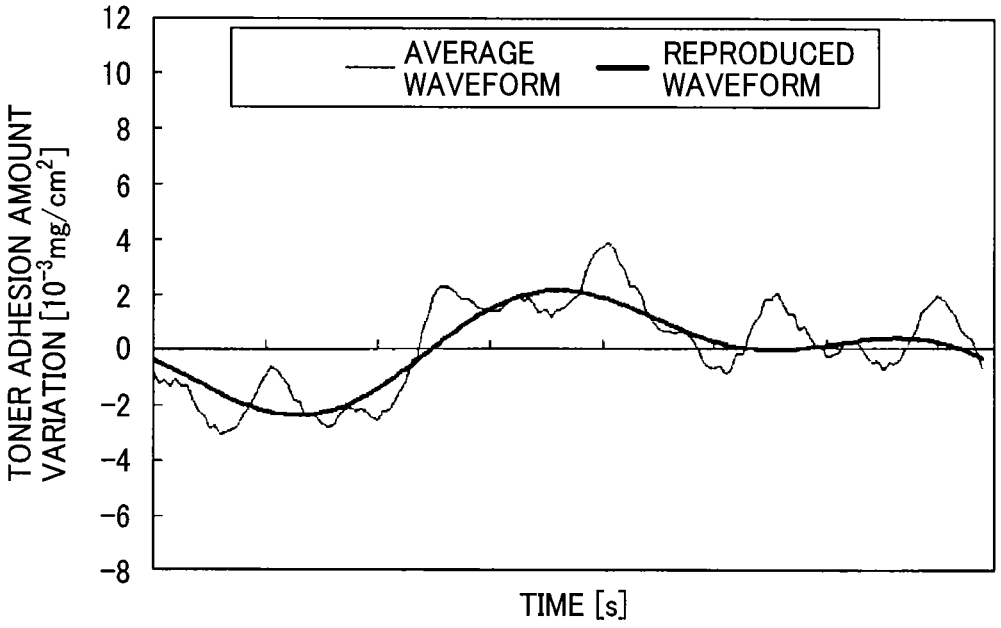
FIG. 17 is a graph illustrating chronological change in the toner adhesion amount variation in an average waveform taken by a sleeve rotary cycle or in a reproduced waveform converted for reproduction.

FIG. 17 is a graph illustrating chronological change in the toner adhesion variation amount in an average waveform of cutout waveforms by a sleeve rotary cycle or in a reproduced waveform converted for reproduction. In the same figure, the average waveform is obtained by averaging ten cutout waveforms cut out from the density variation pattern data by the sleeve rotary cycle to formulate the development variation pattern data for the sleeve cycle. The average waveform can be substantially completely reproduced by superimposing several sine waves varying at a cycle twenty times that of the sleeve rotary cycle. However, the image density variation following the change in the developing bias does not follow well when the bias variation frequency is high, for the following reason.

The electrostatic latent image on the photoconductor is developed when the electrostatic latent image exists within the development area length L as illustrated in FIG. 6. Even though the output value of the developing bias is finely changed within a time from the electrostatic latent image enters and then passes through the development area, it is very difficult that the image density of the electrostatic latent image is changed finely following the change in the output value of the developing bias. The average bias value in the above sequence greatly affects the image density of the electrostatic latent image, and the temporary bias change does not have much effect on the image density. If the development area length L is shortened too much to obviate this phenomenon, the necessary developing power is not obtained. The frequency of the cyclic variation component of the image density that can be suppressed by changing the developing bias has an upper limit.

As a result, in the copier according to the first embodiment, the frequency that equals to three times that of the sleeve rotary cycle is set to an upper limit frequency of the to-be-extracted cyclic variation component. Specifically, the sine waves varying at a cycle three times that of the sleeve rotary cycle are superimposed, so that an average waveform is reproduced. The reproduced waveform as illustrated in FIG. 16 is obtained by a method as described above. The controller 110 formulates, based on the reproduced waveform, the development variation pattern data for the photoconductor cycle and the development variation pattern data for the sleeve cycle.

A specific formulation process is as follows. First, the controller 110 analyzes a frequency as to the average waveform. The frequency analysis may be performed by Fourier transformation (FFT) or alternatively, by the orthogonal waveform detection. The copier according to the present embodiment is performed by the orthogonal waveform detection.

The average waveform as illustrated in FIG. 14 is represented by superimposition of sine waves cyclically varying at a frequency being an integral multiple of the frequency of the sleeve rotary cycle, as in the following formula. In the following formula, x is an upper limit of the varying frequency of the sine wave.

$$f(t)=A_1\times\sin(\omega t+\theta_1)+A_2\times\sin(2\times\omega t+\theta_2)A_3\times\sin(3\times\omega t+\theta_3)+\ldots+A_x\times\sin(x\times\omega t+\theta_x)$$

The above formula can be transformed to the formula below.

$$f(t)=\Sigma A_i\times\sin(i\times\omega t+\theta_i)$$

Herein, i is a natural number of 1 to x.

f(t): Average waveform of the cutout waveforms of the toner adhesion variation amount [$10^{-3}$ mg/cm$^2$]

$A_i$: Amplitude of sine wave [$10^{-3}$ mg/cm$^2$]

ω: Angular speed of the sleeve or the photoconductor [rad/s]

$\theta_i$: Phase of the sine wave [rad]

t: Time [s]

In the copier according to the first and other exemplary embodiments, $A_i$ and $\theta_i$ are calculated by the orthogonal waveform detection, and the density variation component of each frequency is calculated. The reproduced waveform to formulate the development variation pattern data for the sleeve cycle and the reproduced waveform to formulate the development variation pattern data for the photoconductor cycle are formulated based on the following formula:

$$f_{1/2}(t)=\Sigma A_i\times\sin(i\times\omega t+\theta_i)$$

Herein, i=1 to 3. i=1 means one rotary cycle of the photoconductor.

Formulation of the development variation pattern data has been described, and the charge variation pattern data will be formulated similarly.

Figure 18:
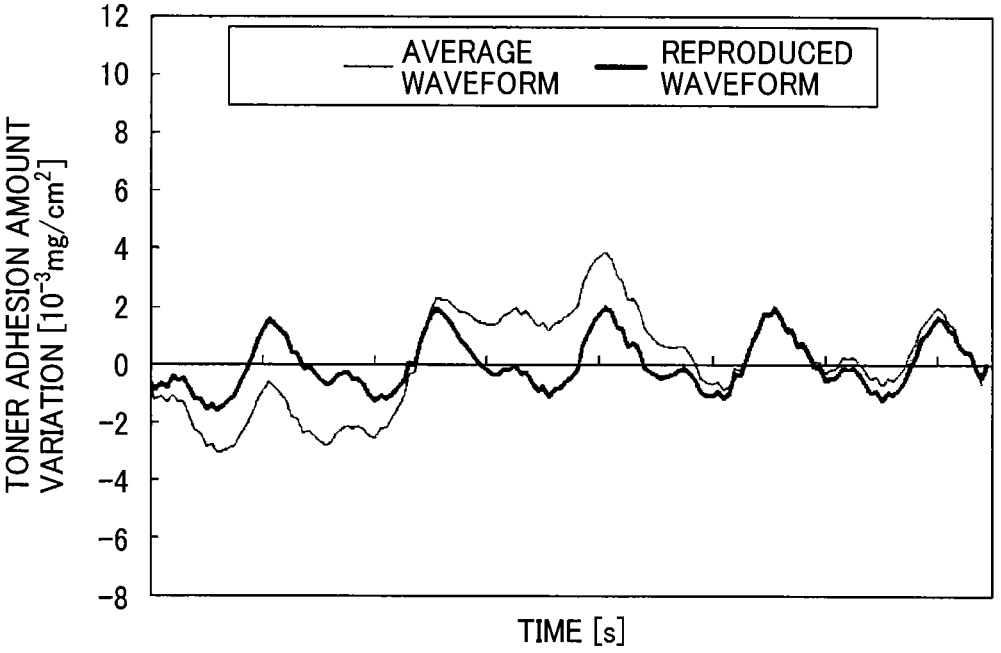
FIG. 18 is a graph illustrating chronological change in the toner adhesion amount variation in an average waveform referred to when building a latent image variation pattern data to change the writing optical amount or in a reproduced waveform converted for reproduction from the average waveform.

FIG. 18 is a graph illustrating chronological change in the toner adhesion variation amount in the average waveform to be referred to when formulating the latent image variation pattern data to change the writing light amount or in the reproduced waveform converted for reproduction. In the copier according to the first embodiment, the residual cyclic variation in the image density can be suppressed by changing the writing light amount relative to the photoconductor based on the latent image variation pattern data during a print job. The latent image variation pattern data is formulated based on the density variation pattern of the toner image for detecting the solid density variation created for formulating the development variation pattern data. The development variation pattern data and the charge variation pattern data, as described heretofore, are formulated based on the reproduced waveform extracting the cyclic variation component of the frequency of three times the frequency of the sleeve rotary cycle. As a result, high frequency cyclic variation component remains as an image density variation. This is the residual cyclic variation in the image density of the copier according to the first embodiment. The present residual cyclic variation pattern can be recognized based on the density variation pattern of the toner image for detecting the solid density variation image formed for formulating the development variation pattern data.

The image density variation by changing the writing light amount can be generated by the unit of one dot, which can be used as an effective means to cancel the cyclic variation component occurring by the high frequency cycle. Accordingly, the controller 110 formulates the reproduced waveform to formulate the latent image variation pattern data for the sleeve cycle and the reproduced waveform to formulate the latent image variation pattern data for the photoconductor cycle based on the following formula:

$$f_3(t)=\Sigma A_i \times \sin(i \times \omega t+\theta_i)$$

Herein, i is a natural number from 4 to 20.

FIG. 18 is the thus-formulated reproduced waveform. The controller 110 formulates, based on the reproduced waveform, the latent image variation pattern data for the sleeve cycle and the latent image variation pattern data for the photoconductor cycle. Those data reflects the writing light amount or the optical write intensity exerted by the laser diode power (LDP) [%]. By multiplying gain appropriately on the writing light amount, the high frequency component in the target image density can be reduced. The exposure strength or the LD power in the present embodiment is cyclically changed to cancel the high frequency component as illustrated by a solid line in FIG. 13.

When forming an image based on a command from the user, the controller 110 formulates a following superimposed variation pattern data based on the latent image variation pattern data for the photoconductor cycle, the latent image variation pattern data for the sleeve cycle, the photoconductor reference attitude timing, and the sleeve reference attitude timing. More specifically, the superimposed variation pattern data generates the superimposed variation waveform in which the latent image variation waveform (or the writing light amount variation waveform) of the photoconductor rotary cycle, and the latent image variation waveform of the sleeve rotary cycle are superimposed. The superimposed variation pattern data is sequentially sent from the controller 110 to the write controller 125. The write controller 125 cyclically changes the writing light amount based on the superimposed variation pattern data. Such a process is performed for each color of Y, C, M, and K, respectively.

In such a configuration, the high frequency residual cyclic variation remaining even though the developing bias and the charging bias have been cyclically changed, can be suppressed effectively. In addition, a following effect can be obtained.

Figure 19:
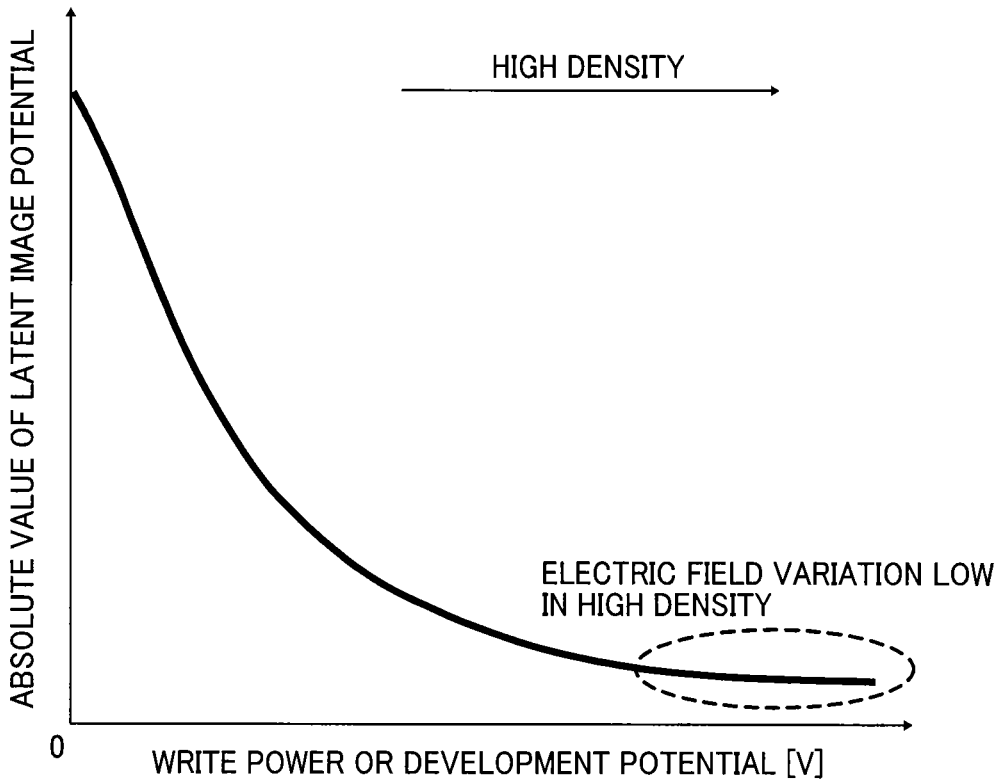
FIG. 19 is a graph illustrating a relation between an absolute value of the latent image potential and the writing light quantity or development potential.

Specifically, as illustrated in FIG. 19, because the electric field variation is reduced in the higher image density area due to the photo-induced discharge characteristics of the photoconductor, the correction is not performed effectively. Because the latent image potential does not vary in the higher image density area, the corrective range of the toner adhesion amount narrows. In general, amplitude of the cyclic variation in the image density occurring in the sleeve rotary cycle or the photoconductor rotary cycle is larger in the low frequency component and is smaller in the high frequency component. In the copier according to the first embodiment, the cyclic variation component in the low frequency having a large amplitude can be reduced by cyclically changing the developing bias and the charging bias. By contrast, the cyclic variation component of the higher frequency with a relatively smaller amplitude can be corrected by the writing light amount. With this structure, even in the higher image density area, the writing light amount is not saturated in the upper limit, and the variation range of the target latent image potential can be secured.

Figure 20:
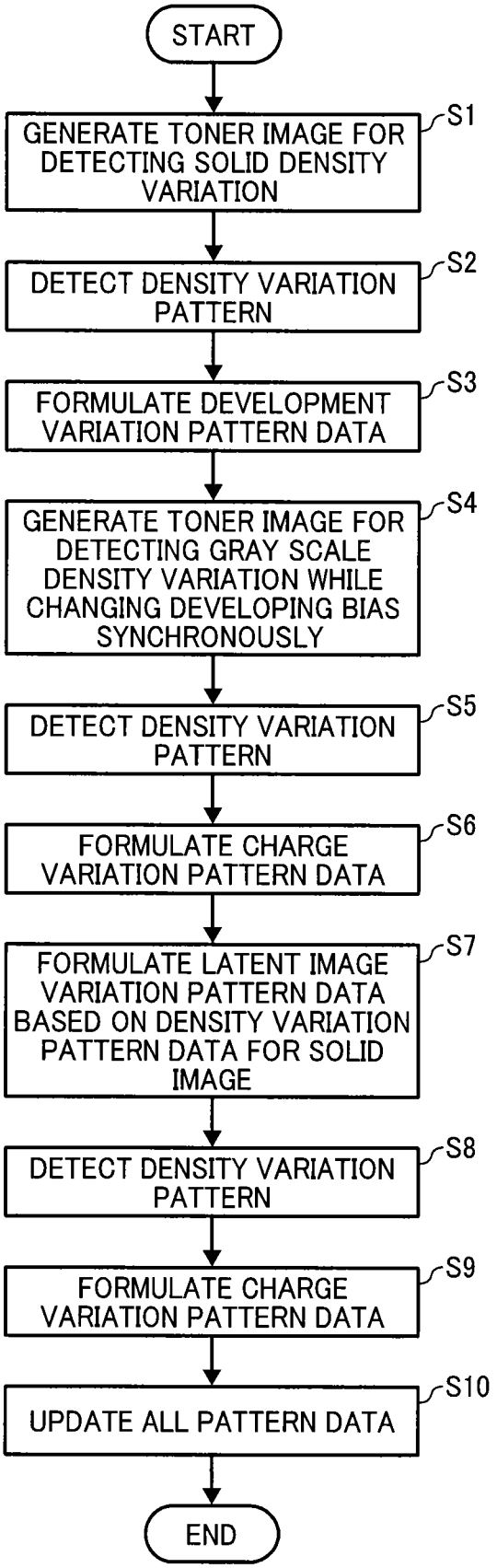
FIG. 20 is a flowchart illustrating a process performed by a controller of the copier according to the first embodiment.

FIG. 20 is a flowchart illustrating a process performed by the controller (that is, the controller 110 and the write controller 125) of the copier according to the first embodiment. The controller 110 forms a toner image for detecting the solid density variation (in step S1). Herein, the developing bias, the charging bias, and the writing light amount are set constant. Next, after the density variation pattern of the toner image for detecting the solid density variation is detected (S2), the development variation pattern data is formulated based on the density variation pattern (S3). Then, while cyclically changing the developing bias based on the development variation pattern data and the like, the toner image for detecting the halftone density variation is formed (S4), and the density variation pattern of the toner image for detecting the halftone density variation is detected (S5). Further, after the charge variation pattern is formulated based on the density variation pattern and the like (S6), the latent image variation pattern data is formulated (S7) based on the density variation pattern of the toner image for detecting the solid density variation detected in the above S2. At last, each of the development variation pattern data, the charge variation pattern data, and the latent image variation pattern data that have been stored up until the start of this process are updated to new data obtained in the present process (S8). Such a process is performed for each color of Y, C, M, and K, respectively. Processing for each color may be performed sequentially from one color to another, and alternatively, processing for more than two colors may be performed in parallel.

[Second Embodiment]

The copier according to the second embodiment formulates the development variation pattern data and the charge variation pattern data, changes the writing light amount, and formulates the latent image variation pattern data for suppressing the residual cyclic variation in the image density. Specifically, first, while cyclically changing the developing bias based on the development variation pattern data, the controller 110 cyclically changes the charging bias based on the charge variation pattern data, to thereby form a toner image for detecting the halftone density variation. Then, based on the detection result of the toner adhesion amount of the toner image for detecting the halftone density variation, the controller 110 obtains the residual cyclic variation pattern of the toner adhesion amount of the toner image for detecting the halftone density variation.

It has been found that, from experimental results, the residual cyclic variation in the lower frequency occurs in the halftone image portion even though the halftone image is formed while cyclically changing the developing bias and the charging bias. The residual cyclic variation appears remarkably as the image density of the halftone image portion is decreased. Then, the residual cyclic variation pattern should be obtained as described above.

Upon obtaining the residual cyclic variation pattern, the cyclic variation pattern of the photoconductor rotary cycle and the cyclic variation pattern of the sleeve rotary cycle are extracted from the obtained residual cyclic variation pattern. The controller 110 formulates, based on the extraction results, the latent image variation pattern data for the photoconductor cycle and the latent image variation pattern data for the sleeve cycle. The method of formulating the latent image variation pattern data is similar to that in the first embodiment.

When forming an image based on a command from the user, the controller 110 formulates a following superimposed variation pattern data based on the latent image variation pattern data for the photoconductor cycle, the latent image variation pattern data for the sleeve cycle, the photoconductor reference attitude timing, and the sleeve reference attitude timing. More specifically, the superimposed variation pattern data generates the superimposed variation waveform in which the latent image variation waveform (or the writing light amount variation waveform) of the photoconductor rotary cycle, and the latent image variation waveform of the sleeve rotary cycle are superimposed. The superimposed variation pattern data is sequentially sent from the controller 110 to the write controller 125. The write controller 125 cyclically changes the writing light amount based on the superimposed variation pattern data. Such a process is performed for each color of Y, C, M, and K, respectively.

In such a configuration, the residual cyclic variation remarkable in the halftone portion with a low image density even though the developing bias and the charging bias have been cyclically changed, can be suppressed effectively.

Figure 21:
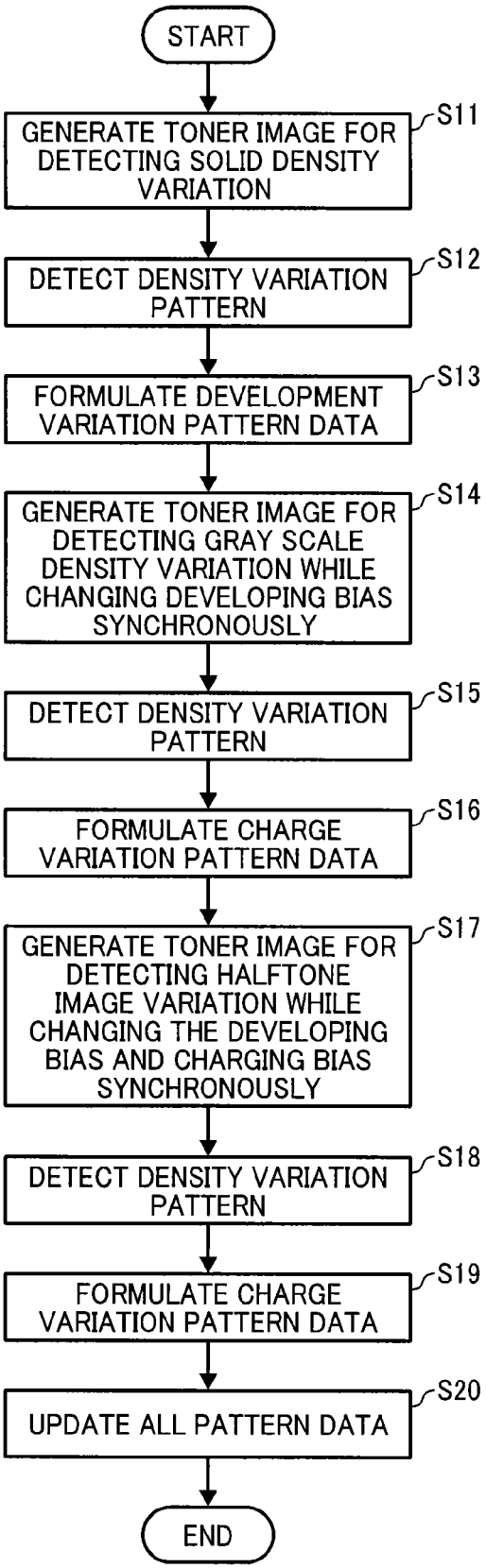
FIG. 21 is a flowchart illustrating a process performed by the controller of the copier according to a second embodiment.

FIG. 21 is a flowchart illustrating a first example of a process flow performed by the controller of the copier according to the second embodiment. In the present process flow, the steps from S11 to S16 are the same as those steps in FIG. 20, and therefore, the explanation thereof is omitted. After the step 516, the controller 110 cyclically changes the developing bias based on the development variation pattern data, and, while cyclically changing the charging bias based on the charge variation pattern data, forms again the toner image for detecting the halftone density variation (S17). Then, after having detected the density variation pattern of the toner image for detecting the halftone density variation (S18), the controller 110 formulates the latent image variation pattern data based on the density variation pattern (S19). At last, the controller 110 updates each of the development variation pattern data, the charge variation pattern data, and the latent image variation pattern data that have been stored up until the start of this process to new data obtained in the present process (S20). Such a series of processes are performed for each color of Y, C, M, and K, respectively. Processing for each color may be performed sequentially from one color to another, and alternatively, processing for more than two colors may be performed in parallel.

[Third Embodiment]

Next, a third embodiment of the copier based on the copier according to the second embodiment will be described. Unless specified in particular, a schematic structure of the copier according to the third embodiment is identical with the copier according to the second embodiment.

In the copier according to the second embodiment, the residual cyclic variation in the image density that is remarkable in the halftone portion with the low image density can be suppressed effectively by changing the writing light amount based on the light quantity variation pattern data. In such a configuration, however, the engineers found that the residual cyclic variation becomes unexpectedly remarkable in the halftone portion with a high image density.

Thus, the controller 110 of the copier according to the third embodiment obtains the image density of each portion of the output image based on the input image information, and transfers the obtained results to the write controller 125. The write controller 125 cyclically changes the writing light amount only when writing a halftone portion of the latent image with a low to medium image density among the whole latent image. With this structure, the write controller 125 writes the latent image without cyclically changing the writing light amount as to the halftone portion of the latent image with a high image density, so that the residual cyclic variation is prevented from becoming remarkable contrary to the expectation. As a result, regardless of the image density, the residual cyclic variation in the halftone portion can be suppressed effectively.

Figure 22:
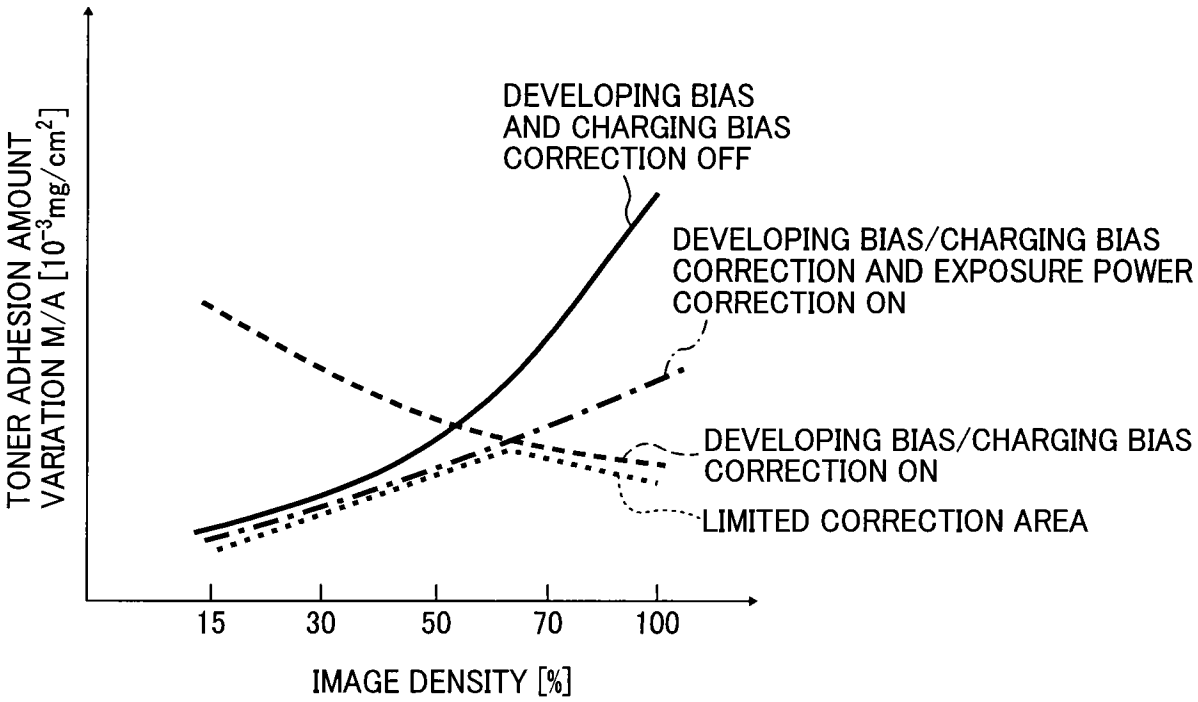
FIG. 22 is a graph illustrating a relation between the toner adhesion amount, image density, and a control parameter to be changed cyclically.

FIG. 22 is a graph illustrating a relation between the toner adhesion variation amount, the image density, and a control parameter for changing cyclically. In each of the present embodiments, an area coverage modulation is adopted to express gradation of the halftone. In FIG. 22, the unit of the image density is represented by %. That the image density is 100% means a solid image. As illustrated in FIG. 22, when the three conditions of the developing bias, the charging bias, and the writing light amount are not cyclically changed, the cyclic change in the image density is more remarkable in the image portion with a high image density. Namely, the toner adhesion variation amount increases.

In the configuration in which the developing bias and the charging bias are cyclically changed, the halftone cyclic change is more remarkable in the halftone portion with a low image density as illustrated in FIG. 22. In the copier according to the second embodiment in which the three conditions are all cyclically changed, the residual cyclic variation in the halftone portion with a high image density is more remarkable compared to the configuration in which the developing bias and the charging bias alone are cyclically changed.

On the other hand, in the copier according to the third embodiment, the write controller 125 cyclically changes the writing light amount only when writing a halftone portion of the latent image with a low to medium image density among the whole latent image, thereby preventing the residual cyclic variation from being remarkable unexpectedly.

[Fourth Embodiment]

Figure 26:
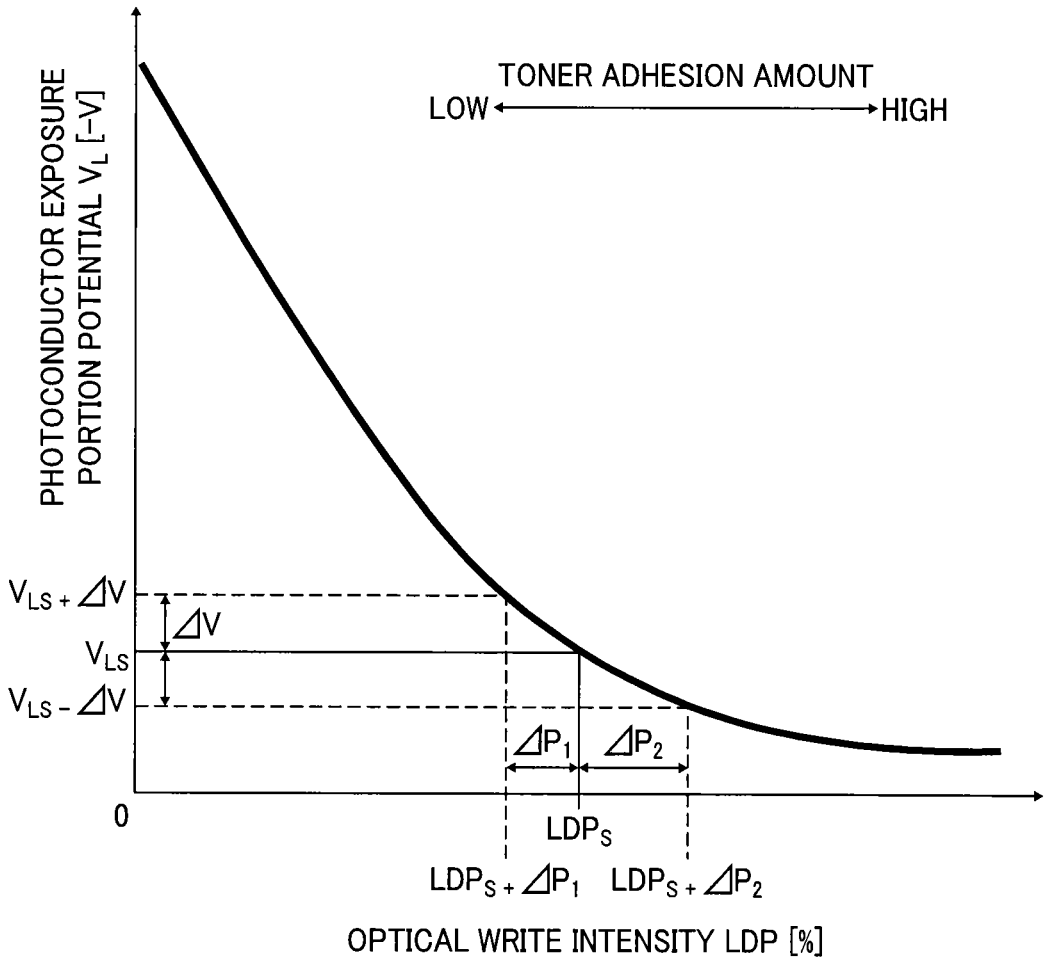
FIG. 26 is a graph to show a photo-induced discharge property of a surface potential of the photoconductor.

FIG. 26 is a graph to show a photo-induced discharge property of a surface potential of the photoconductor 20. A vertical axis of the graph shows an electric potential $V_L$ [V] of the exposure portion of the photoconductor 20, and a horizontal axis thereof shows an optical write intensity LDP [%]. As illustrated, basically, as the optical write intensity LDP increases, the exposure portion potential $V_L$ decreases and the development potential increases, so that the image density increases. When the optical write intensity LDP increases up to a certain value, the lowering rate of the exposure portion potential $V_L$ according to the increase rate of the optical write intensity decreases much.

Because a substantially linear correlation stands between the toner adhesion amount and the development potential of the toner image, the exposure portion potential $V_L$ can be increased or decreased at a same absolute value for the cases of increasing or decreasing the toner adhesion amount. $\Delta V$ in FIG. 26 represents this fact.

On the other hand, when the exposure portion potential $V_L$ is increased by $\Delta V$ [V] or decreased by $\Delta V$ [V] from a standard value $V_{LS}$ determined by the process control, a change amount of the optical write intensity LDP needs to be different. The absolute value of the change amount of the optical write intensity LDP is $\Delta P_1$ when decreasing the exposure portion potential $V_L$ and is $\Delta P_2$ when increasing the same ($\Delta P_1 < \Delta P_2$). As understood from FIG. 26, when increasing the toner adhesion amount, the change amount of the optical write intensity LDP needs to be increased more than in decreasing the toner adhesion amount.

As a result, when formulating the latent image variation pattern data by simply multiplying the variation amount of the toner adhesion amount of the toner image for detecting the halftone density variation by a predetermined coefficient, and by converting the obtained variation amount to the variation amount of the optical write intensity LDP, the exposure portion potential $V_L$ cannot be cyclically changed at a desired pattern.

Figure 27:
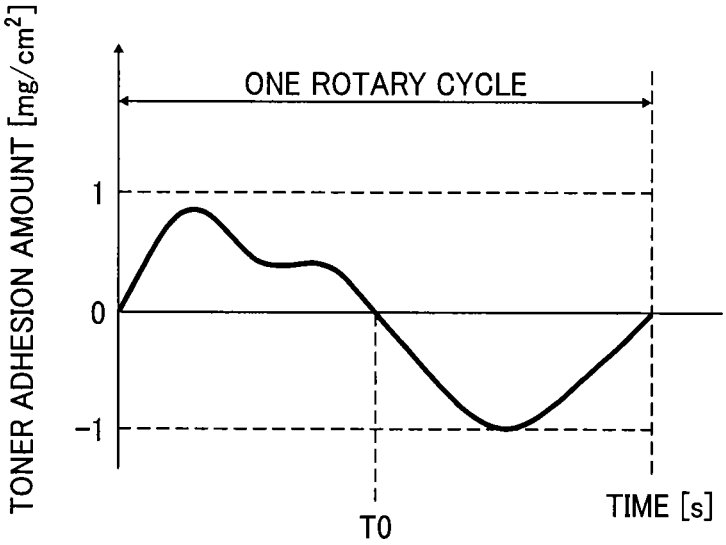
FIG. 27 is a graph illustrating a normalized waveform formulated by a controller of the copier according to a second embodiment.

Then, the controller 110 formulates the latent image variation pattern data for the sleeve cycle and the latent image variation pattern data for the photoconductor cycle as follows. Specifically, first, normalization reproduced waveform data is formulated for each of the sleeve rotary cycle and the photoconductor rotary cycle as illustrated in FIG. 27. The normalization reproduced waveform is obtained by normalizing the reproduced waveform, and represents a cyclic variation in the toner adhesion amount.

Figure 28:
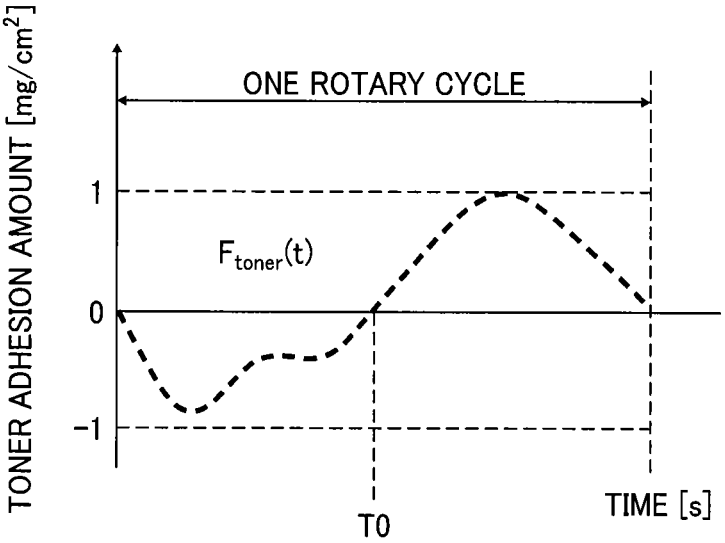
FIG. 28 is a graph illustrating an offsetting variation waveform $F_{toner}(t)$ formulated by the controller of the copier.
Figure 29:
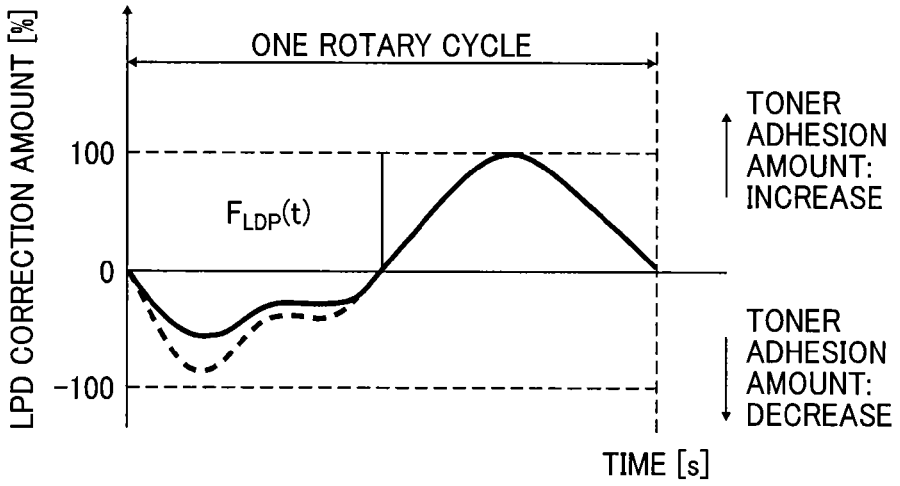
FIG. 29 is a graph illustrating an LDP variation waveform $F_{LDP}(t)$ formulated by the controller of the copier.

Next, the controller 110 formulates data of an offsetting variation waveform $F_{toner}(t)$ as illustrated in FIG. 28, by multiplying the normalization reproduced waveform data by −1. This represents a cyclic variation in the toner adhesion amount intentionally generated for offsetting the cyclic variation in the toner adhesion amount. The controller 110 formulates an LDP variation waveform $F_{LDP}(t)$ as illustrated in FIG. 29 based on the offsetting variation waveform $F_{toner}(t)$. This LDP variation waveform $F_{LDP}(t)$ is the cyclic variation waveform to cause the same cyclic variation as the offsetting variation waveform $F_{toner}(t)$.

In FIG. 29, a dotted line represents the LDP variation waveform obtained by simply multiplying the variation amount of the toner adhesion amount by the coefficient, that is, the simple conversion waveform; and a solid line represents the LDP variation waveform $F_{LDP}(t)$ formulated by the controller 110 of the copier according to the fourth embodiment. As illustrated in FIG. 29, the LDP variation waveform $F_{LDP}(t)$ includes a smaller amplitude of the waveform of the side in which the optical write intensity LDP is corrected to be smaller than the reference value determined by the process control, and the amplitude is smaller than the same waveform portion in the simple converted waveform. One cycle of the cyclic variation waveform of the light irradiation amount includes a boundary with a predetermined reference value between the light irradiation amount increasing side and the light irradiation amount decreasing side. The controller 110 formulates the optical write intensity LDP to cyclically change such that the peak value of the waveform of the irradiation amount increasing side is larger than the peak value of the waveform of the irradiation amount decreasing side.

With such a structure, compared to a case in which the peak value of the waveform of the LDP increasing side and that of the waveform of the LDP decreasing side are set to the same, the cyclical variation in the toner adhesion amount can be suppressed. The optical write intensity LDP and a light irradiation amount per unit area (one dot) relative to the photoconductor 20 are proportional. The controller 110 formulates the optical write intensity LDP to cyclically change such that the peak value of the waveform of the irradiation amount increasing side is larger than the peak value of the waveform of the irradiation amount decreasing side with the predetermined reference value in one cycle of the cyclic variation waveform of the light irradiation amount set as the boundary.

Figure 30:
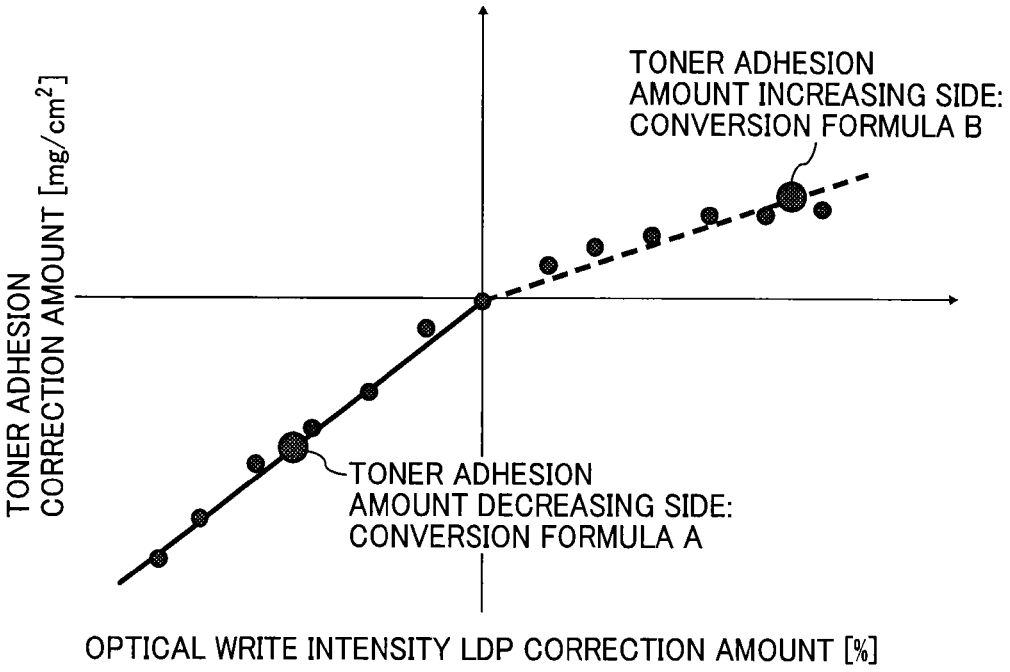
FIG. 30 is a graph illustrating a relation between a correction amount of toner adhesion amount, and a correction amount of optical write intensity.

When formulating the LDP variation waveform $F_{LDP}(t)$ as illustrated in FIG. 29, the controller 110 may be configured to calculate the variation amount of the optical write intensity to change the exposure portion potential $V_L$ by a desired amount using the graph as illustrated in FIG. 26. In addition, as illustrated in FIG. 30, a relation between a correction amount of the toner adhesion amount, and a correction amount of the optical write intensity LDP is obtained by experiments. Specifically, a conversion formula B is formulated to convert the correction amount of the toner adhesion amount when the toner adhesion amount is corrected to increase, into the correction amount of the optical write intensity LDP. Further, a conversion formula A is also formulated to convert the correction amount of the toner adhesion amount when the toner adhesion amount is corrected to decrease, into the correction amount of the optical write intensity LDP. The controller 110 formulates an LDP variation waveform $F_{LDP}(t)$ as illustrated in FIG. 29 based on the above formulae. In the copier according to the fourth embodiment, the LDP variation waveform $F_{LDP}(t)$ is formulated based on the conversion formula A and the conversion formula B.

When the reference value of the charging bias or of the optical write intensity LDP through the above described process control have been changed, the photo-induced discharge property of the exposure portion potential $V_L$ of the photoconductor 20 will change. As a result, in the copier according to the fourth embodiment, as shown in the following Table 1, the controller 110 is configured to employ a combination of the conversion formula A and the conversion formula B which are different from each other, according to the charging bias. In Table 1, each of A and C represents an inclination of the graph. In addition, each of B and D is an intercept of the graph. MpA is a correction amount of the toner adhesion amount.

TABLE 1

| Charging bias [−V] | Toner adhesion amount to optical write intensity Conversion formula A | Toner adhesion amount to optical write intensity Conversion formula B |
|---|---|---|
| 400 | A1 * MpA + B1 | C1 * MpA + D1 |
| 500 | A2 * MpA + B2 | C2 * MpA + D2 |
| 600 | A3 * MpA + B3 | C3 * MpA + D3 |
| 700 | A4 * MpA + B4 | C4 * MpA + D4 |
| 800 | A5 * MpA + B5 | C5 * MpA + D5 |
| 900 | A6 * MpA + B6 | C6 * MpA + D6 |
| 1000 | A7 * MpA + B7 | C7 * MpA + D7 |

As shown in Table 1, by changing the combination of the above elements, degradation of the cyclic variation in the image density due to the change in the charging bias can be suppressed.

In addition, similarly to the fourth embodiment, the copiers according to the first and the third embodiments may formulate the LDP variation waveform $F_{LDP}(t)$ as illustrated in FIG. 29.

Figure 23:
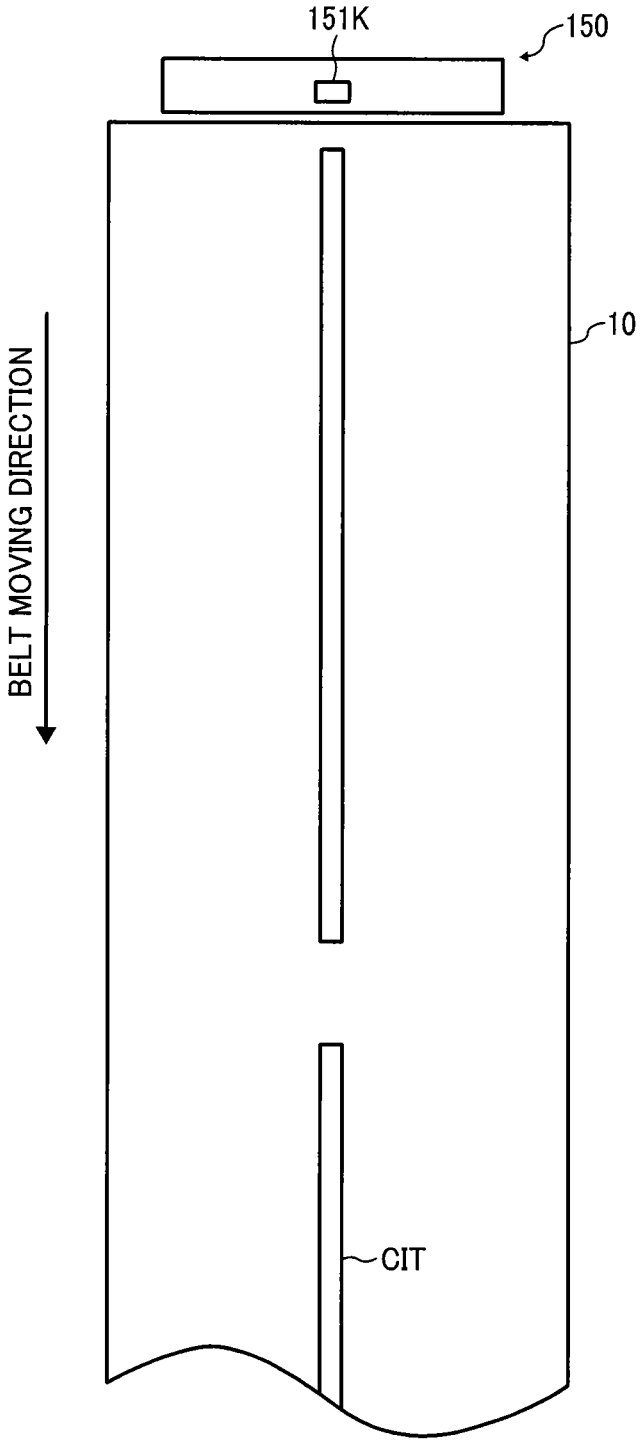
FIG. 23 illustrates a general structure of a copier according to a first modified example.

The optical sensor unit 150 employs four reflection-type photosensors each to detect the toner adhesion amount of the toner image of each color of Y, C, M, and K; however, the number of the reflection-type photosensor is not limited to the number of colors used. For example, the toner adhesion amount of the toner of the colors of Y, C, M, and K can be detected by a single reflection-type photosensor 151 as illustrated in FIG. 23.

Figure 24:
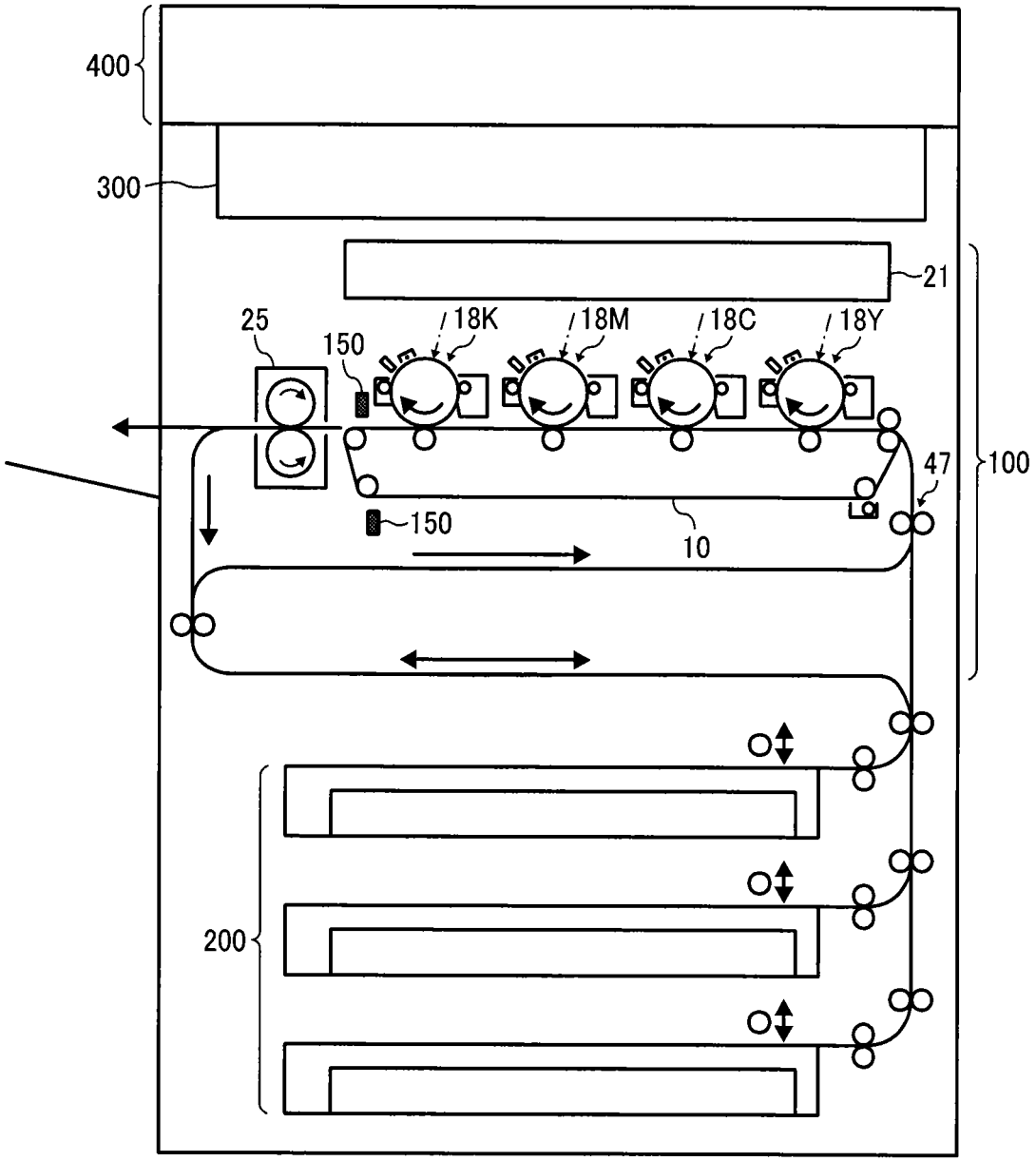
FIG. 24 schematically illustrates a copier according to a second modified example.

In addition, in the aforementioned embodiments, a case in which the toner image on the photoconductor 20 is primarily transferred to the intermediate transfer belt 10 and is secondarily transferred to the recording sheet, has been described; however, as illustrated in FIG. 24, the present invention may be applied to a structure in which the toner image on the photoconductor 20 is directly transferred to the recording sheet.

Figure 25:
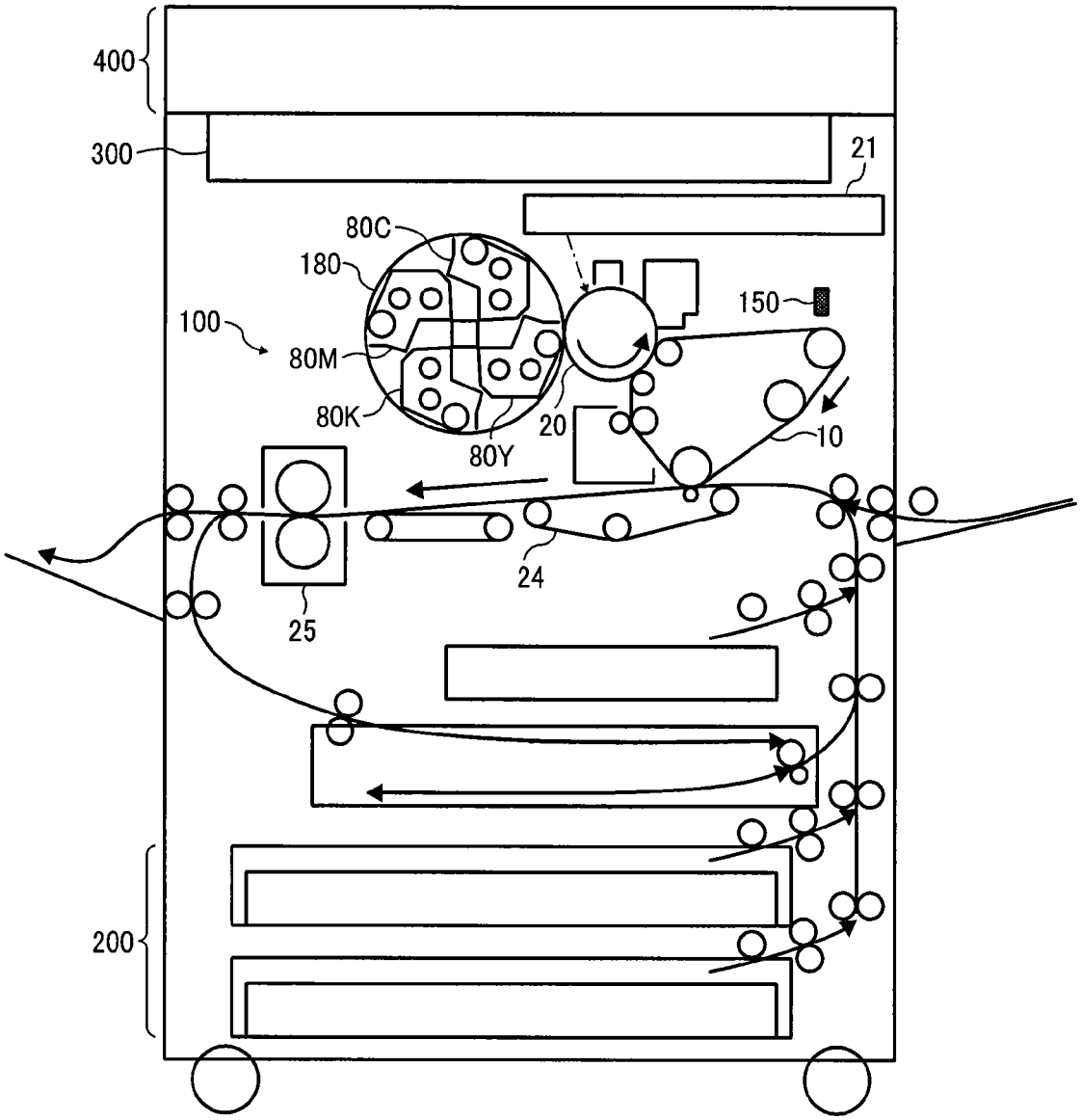
FIG. 25 schematically illustrates a copier according to a third modified example.

In addition, in the aforementioned embodiments, a case in which the Y-, C-, M-, and K-color photoconductors that correspond to the Y-, C-, M-, and K-color tone images, respectively, are disposed; however, the present invention may be applied to a structure in which two or more toner images are formed on a single photoconductor. For example, as illustrated in FIG. 25, a single photoconductor 20 as a common device for each color is disposed. In this configuration, a revolver developing device 180 that causes Y-, C-, M-, and K-color developing devices 80Y, 80C, 80M, and 80K to rotate about a revolution axis is disposed on the side of the photoconductor 20 that is a common device for each color. In the process of sequentially writing the electrostatic latent images for Y-, C-, M-, and K-color on the photoconductor 20, the revolver developing device 180 is rotated appropriately, thereby developing the electrostatic latent images. During such a process to cyclically rotate the intermediate transfer belt 10 over than four cycles, the Y-, C-, M-, and C-toner images obtained through the above development, are superimposed in each cyclic rotation, thereby primarily transferring them onto the intermediate transfer belt 10. Then, the thus-obtained four-color superimposed toner image is secondarily transferred to the recording sheet.

The copier according to the embodiments of the present invention is not limited to the embodiments described heretofore, but various modification and change are possible. For example, the image forming apparatuses to which the presently embodied invention may be applied include a printer, a facsimile machine, and a multifunction apparatus, instead of a copier. Further, the presently embodied invention may be applied not only to the image forming apparatus forming a color image, but to a monochrome image forming apparatus that can form monochrome images only. Further, the presently embodied invention may be applied not only to the image forming apparatus forming the image on one side of the recording sheet, but to both sides of the recording sheet, if necessary. Examples of recording sheet include a regular sheet, an OHP sheet, a card, a postcard, a thick sheet, an envelope, and the like.

The aforementioned embodiments are examples and specific effects can be obtained for each of the following aspects:

[Aspect A]

According to Aspect A, provided is an image forming apparatus (for example, a copier 1000) including an image forming section (for example, an image forming section 100), that includes: a latent image bearer (for example, a photoconductor 20); a charger (for example, a charging roller 71) to charge a surface of the latent image bearer; and a latent image writer (for example, a laser writer 21) to write a latent image on the charged surface of the latent image bearer. The image forming apparatus further includes a developing device (for example, a developing device 80) to develop the latent image with a developer borne on a developer bearer (for example, a development sleeve 81); and a cyclical changing device (for example, a combination of a controller 110 and a write controller 125) to cyclically change a developing bias to be applied to the developer bearer while cyclically changing the charge intensity by the charger during the image formation by the image forming section. The cyclical changing device cyclically changes the developing bias and the charge intensity, and in addition, cyclically changes the latent image write intensity by the latent image writer.

Engineers of the present invention found that a cyclical image density variation remains even though a structure to form a latent image on the latent image bearer and develop the latent image while cyclically changing the developing bias and the charging bias is applied. Further, the engineers of the present invention found that, as described in the first and second embodiments, in addition to cyclically changing the developing bias and the charge intensity, the cyclic image density variation can be suppressed by cyclically changing the latent image write intensity by the latent image writer. Accordingly, in Aspect A, in addition to cyclically changing each of the developing bias and the charge intensity, the cyclic image density variation remaining even though the developing bias and the charge intensity are cyclically changed, respectively, can be suppressed by cyclically changing the latent image write intensity by the latent image writer.

[Aspect B]

According to Aspect B, in Aspect A, the latent image bearer is a photoconductor, the latent image writer writes an electrostatic latent image to the photoconductor by optical irradiation of light, the latent image write intensity can be obtained by detecting a light irradiation amount of the latent image writer, and the cyclical changing device is configured to change the light irradiation amount of the latent image writer cyclically. In the above configuration, by cyclically changing the light irradiation amount, as the engineers of the present invention found, the cyclic image density variation remaining even though the developing bias and the charge intensity are cyclically changed, respectively, can be suppressed more than ever before.

[Aspect C]

According to Aspect C, in Aspect B, one cycle of the cyclic variation waveform of the light irradiation amount includes a boundary with a predetermined reference value between the light irradiation amount increasing side and the light irradiation amount decreasing side. The controller (for example, the controller 110) formulates the optical write intensity LDP to cyclically change such that a peak value of the waveform of the irradiation amount increasing side is larger than a peak value of the waveform of the irradiation amount decreasing side. With such a structure as explained in the fourth embodiment, compared to a case in which the peak value of the waveform of the LDP increasing side and that of the waveform of the LDP decreasing side are set to the same, the cyclical variation in the toner adhesion amount can be suppressed.

[Aspect D]

According to Aspect D, in Aspect A to C, a solid toner image is formed on the latent image bearer without cyclically changing any of the three of the developing bias, the charge intensity, and the latent image write intensity; and based on the detected image density variation in the solid toner image in the surface direction of movement of the image bearer, a development variation pattern is formulate; a charge variation pattern is formulated based on the result detecting the image density variation pattern in the surface direction of movement of the halftone toner image formed by cyclically changing the developing bias alone among the three; when forming a toner image in response to a command from a user, the developing bias is cyclically changed based on the development variation pattern and the charge intensity is cyclically changed based on the charge variation pattern. The controller and the write controller is thus configured. In such a configuration, the development variation pattern that can suppress the cyclical variation in the image density in the solid portion of the image, and the charge variation pattern that can suppress the cyclical variation in the image density in the halftone portion due to the cyclical variation in the developing bias, can be formulated automatically by the effect of the controller.

[Aspect E]

According to Aspect E, in Aspect D, the latent image variation pattern is formulated based on the results that the image density variation in the frequency higher than that of the varying frequency component included in the development variation pattern is extracted from the image density variation pattern of the solid toner image, and when forming a toner image responsive to a command from a user, the controller and the write controller are configured to cyclically change the latent image write intensity based on the latent image variation pattern. In such a configuration, as explained in the first embodiment, the high frequency residual cyclic variation remaining even though the developing bias and the charging bias have been cyclically changed, can be suppressed effectively.

[Aspect F]

According to Aspect F, in Aspect E, the controller and the write controller are configured such that: the cyclic variation component of a predetermined frequency or below is extracted from the image density variation in the solid toner image, to formulate the development variation; and the cyclic variation component of a predetermined frequency or higher is extracted from the image density variation pattern, to formulate the latent image variation pattern.

The predetermined frequency is equal to or more of the rotary cycle of a rotary member having a minimum rotary cycle and less than five times that the rotary cycle of the same, among the rotary members that cyclically change the image density while rotating. The frequency of the high cyclic variation component higher than the predetermined frequency is preferably double the frequency of the above minimum rotary member or more.

[Aspect G]

According to Aspect G, in Aspect D, the controller and the write controller are so configured as to, after formulating the charge variation pattern, while cyclically changing the developing bias according to the development variation pattern, cyclically change the charge intensity in accordance with the charge variation pattern, and form a halftone toner image; formulate the latent image variation pattern based on the result detecting the image density variation pattern in the surface direction of movement of the halftone toner image; when forming a toner image based on a command from a user, cyclically change the latent image write intensity in accordance with the latent image variation pattern. In such a configuration, as explained in the second embodiment, the residual cyclic variation remarkable in the halftone portion with a low image density even though the developing bias and the charging bias cyclically have been cyclically changed, can be suppressed effectively.

[Aspect H]

According to Aspect H, in Aspect G, the cyclical changing device is so configured as to: obtain the image density in each section of the output image based on the image information, and cyclically change the latent image write intensity when writing a latent image of an image portion having a predetermined image density alone. In such a configuration, as described in the third embodiment, the residual cyclic variation in the halftone portion of the high image density due to a cyclical change in the write intensity, is prevented from becoming remarkable contrary to the expectation.

[Aspect I]

According to Aspect G, in Aspect E to H, the image forming apparatus further includes: a rotary attitude sensor (for example, the photoconductor rotary sensor 76, the sleeve rotary sensor 83) to detect a rotary attitude of the rotary member (for example, the photoconductor 20, the development sleeve 81) that cyclically changes the image density while rotating, and the cyclical changing device is so configured as to obtain a specific timing in one rotary cycle of the rotary member based on the readings from the rotary attitude sensor, formulate each of the development variation pattern, the charge variation pattern, and the latent image variation pattern, respectively, based on the obtained results by the rotary attitude sensor, and when forming a toner image based on the command from a user, cyclically change the developing bias, the charge intensity, and the latent image write intensity based on the readings obtained. Thus, the cyclical variation in the image density variation occurring in the rotary cycle of the rotary member can be suppressed.

[Aspect J]

In Aspect I, Aspect J further includes a replacement sensor (for example, a unit attach/detach sensor 17), and the cyclical changing device is so configured as to formulate again the development variation pattern, the charge variation pattern, and the latent image variation pattern, based on the fact that the replacement is detected by the replacement sensor. With such a configuration, the cyclical changing device or the controller updates each of the development variation pattern, the charge variation pattern, and the latent image variation pattern that become inadequate due to replacement of the rotary member.

[Aspect K]

In any of the aspects E to J, Aspect K further includes an environment sensor (for example, an environment sensor 124) to detect an environment of the apparatus (for example, temperature and humidity in the apparatus), and the cyclical changing device is configured to newly formulate the development variation pattern, the charge variation pattern, and the latent image variation pattern based on the result of the environmental change detected by the environment sensor. With such a configuration, each of the development variation pattern, the charge variation pattern, and the latent image variation pattern that become inadequate due to an environmental change can be updated adequately.

Additional modifications and variations in the present invention are possible in light of the above teachings. It is therefore to be understood that, within the scope of the appended claims, the invention may be practiced other than as specifically described herein.

What is claimed is:

1. An image forming apparatus, comprising:

an image forming section including a latent image bearer;

a charger to charge a surface of the latent image bearer; and a latent image writer to write a latent image on the charged surface of the latent image bearer;

a developing device to develop the latent image with a developer borne on a developer bearer; and a cyclical changing device including a controller and a write controller, in combination, to cyclically change, within a cycle of rotation of the latent image bearer or the developer bearer, a developing bias applied to the developer bearer while cyclically changing a charge intensity of the charger and a latent image write intensity of the latent image writer.

2. The image forming apparatus as claimed in claim 1, wherein the latent image bearer is a photoconductor, the latent image writer writes an electrostatic latent image to the photoconductor by irradiation of the image bearer with light, the latent image write intensity is obtained by detecting a light irradiation amount of the latent image writer, and the cyclical changing device changes the light irradiation amount of the latent image writer cyclically.

3. The image forming apparatus as claimed in claim 2, wherein:

one cycle of a cyclic variation waveform of the light irradiation amount includes a boundary with a predetermined reference value between a light irradiation amount increasing side and a light irradiation amount decreasing side; and the cyclical changing device formulates the light irradiation amount to cyclically change such that a peak value of the waveform of the irradiation amount increasing side is larger than a peak value of the waveform of the irradiation amount decreasing side.

4. The image forming apparatus as claimed in claim 1, wherein:

the cyclical changing device formulates a development variation pattern based on a detection result of an image density variation pattern in a solid toner image in a direction of movement of the surface of the latent image bearer, the solid toner image formed on the latent image bearer without cyclically changing any of three of the developing bias, the charge intensity, and the latent image write intensity;

the cyclical changing device formulates a charge variation pattern based on a detection result of an image density variation pattern in a halftone toner image in the direction of movement, the halftone toner image formed by cyclically changing the developing bias alone among the three; and when forming a toner image in response to a command from a user, the cyclical changing device cyclically changes the developing bias based on the development variation pattern and the charge intensity based on the charge variation pattern.

5. The image forming apparatus as claimed in claim 4, wherein:

the cyclical changing device formulates a latent image variation pattern based on a result in which image density variation of a frequency higher than that of a varying frequency component included in the development variation pattern is extracted from the image density variation pattern of the solid toner image; and when forming a toner image in response to a command from a user, the cyclical changing device cyclically changes the latent image write intensity based on the latent image variation pattern.

6. The image forming apparatus as claimed in claim 5, wherein:

the cyclical changing device extracts a cyclic variation component of a predetermined frequency or lower from the image density variation pattern of the solid toner image, to formulate the development variation; and the cyclical changing device extracts a cyclic variation component of a frequency higher than the predetermined frequency from the image density variation pattern, to formulate the latent image variation pattern.

7. The image forming apparatus as claimed in claim 5, further comprising a rotary attitude sensor to detect a rotary attitude of a rotary member that cyclically changes an image density while rotating, wherein the cyclical changing device obtains a specific timing in one rotary cycle of the rotary member based on a readings from the rotary attitude sensor, formulates each of the development variation pattern, the charge variation pattern, and the latent image variation pattern, respectively, based on the obtained timing by the rotary attitude sensor, and, when forming a toner image based on a command from a user, cyclically changes the developing bias, the charge intensity, and the latent image write intensity based on the readings from the rotary attitude sensor.

8. The image forming apparatus as claimed in claim 7, further comprising a replacement sensor, wherein the cyclical changing device reformulates the development variation pattern, the charge variation pattern, and the latent image variation pattern when the replacement sensor detects replacement of the rotary member.

9. The image forming apparatus as claimed in claim 5, further comprising an environment sensor to detect an environment of the apparatus, wherein the cyclical changing device reformulates the development variation pattern, the charge variation pattern, and the latent image variation pattern based on a result of environmental change detected by the environment sensor.

10. The image forming apparatus as claimed in claim 4, wherein the cyclical changing device is further configured to:

after formulating the charge variation pattern, while cyclically changing the developing bias according to the development variation pattern, cyclically change the charge intensity in accordance with the charge variation pattern, and form a halftone toner image;

formulate the latent image variation pattern based on the detection result of the image density variation pattern in the halftone toner image in the direction of movement of the surface of the latent image bearer; and when forming a toner image based on a command from a user, cyclically change the latent image write intensity in accordance with the latent image variation pattern.

11. The image forming apparatus as claimed in claim 10, wherein the cyclical changing device obtains an image density in each section of an output image based on image information and cyclically changes the latent image write intensity when writing a latent image of an image portion having a predetermined image density alone.

12. An image forming apparatus, comprising:

an image forming section including a photoconductor, a charging roller to charge a surface of the photoconductor, and a laser writer to write a latent image on the charged surface of the photoconductor;

a developing device to develop the latent image with a developer borne on a development sleeve;

a controller; and a write controller, in combination with the controller, to cyclically change, within a cycle of rotation of the photoconductor or the development sleeve, a developing bias applied to the development sleeve while cyclically changing a charge intensity by the charging roller and a latent image write intensity by the laser writer.

13. The image forming apparatus of claim 12, wherein the controller and the write controller, in combination, formulate a development variation pattern based on a detection result of an image density variation pattern in a solid toner image in a direction of movement of the surface of the photoconductor, the solid toner image formed on the photoconductor without cyclically changing any of three of the developing bias, the charge intensity, and the latent image write intensity;

the controller and the write controller, in combination, formulate a charge variation pattern based on a detection result of an image density variation pattern in a halftone toner image in the direction of movement, the halftone toner image formed by cyclically changing the developing bias alone among the three; and when forming a toner image in response to a command from a user, the controller and the write controller, in combination, cyclically change the developing bias based on the development variation pattern and the charge intensity based on the charge variation pattern.

14. The image forming apparatus of claim 13, wherein the controller and the write controller, in combination, formulate a latent image variation pattern based on a result in which image density variation of a frequency higher than that of a varying frequency component included in the development variation pattern is extracted from the image density variation pattern of the solid toner image; and when forming a toner image in response to a command from a user, the controller and the write controller, in combination, change the latent image write intensity based on the latent image variation pattern.

15. The image forming apparatus of claim 14, wherein the controller and the write controller, in combination, extract a cyclic variation component of a predetermined frequency or lower from the image density variation pattern of the solid toner image, to formulate the development variation; and the controller and the write controller, in combination, extract a cyclic variation component of a frequency higher than the predetermined frequency from the image density variation pattern, to formulate the latent image variation pattern.

16. The image forming apparatus of claim 14, further comprising a rotary attitude sensor to detect a rotary attitude of a rotary member that cyclically changes an image density while rotating, wherein the controller and the write controller, in combination, obtain a specific timing in one rotary cycle of the rotary member based on a readings from the rotary attitude sensor, formulate each of the development variation pattern, the charge variation pattern, and the latent image variation pattern, respectively, based on the obtained timing by the rotary attitude sensor, and, when forming a toner image based on a command from a user, cyclically change the developing bias, the charge intensity, and the latent image write intensity based on the readings from the rotary attitude sensor.

17. The image forming apparatus of claim 16, further comprising a replacement sensor, wherein the controller and the write controller, in combination, reformulate the development variation pattern, the charge variation pattern, and the latent image variation pattern when the replacement sensor detects replacement of the rotary member.

18. The image forming apparatus of claim 14, further comprising an environment sensor to detect an environment of the apparatus, wherein the controller and the write controller, in combination, reformulate the development variation pattern, the charge variation pattern, and the latent image variation pattern based on a result of environmental change detected by the environment sensor.

19. The image forming apparatus of claim 13, wherein the controller and the write controller, in combination, are further configured to:

after formulating the charge variation pattern, while cyclically changing the developing bias according to the development variation pattern, cyclically change the charge intensity in accordance with the charge variation pattern, and form a halftone toner image;

formulate the latent image variation pattern based on the detection result of the image density variation pattern in the halftone toner image in the direction of movement of the surface of the latent image bearer; and when forming a toner image based on a command from a user, cyclically change the latent image write intensity in accordance with the latent image variation pattern.

20. The image forming apparatus of claim 19, wherein the controller and the write controller, in combination, obtain an image density in each section of an output image based on image information and cyclically change the latent image write intensity when writing a latent image of an image portion having a predetermined image density alone.

* * * * *